US009978292B2

(12) United States Patent
Santoro, Jr.

(10) Patent No.: US 9,978,292 B2
(45) Date of Patent: May 22, 2018

(54) SELF-ERECTABLE DISPLAYS AND METHODS OF MAKING SUCH SELF-ERECTABLE DISPLAYS

(71) Applicant: R.R. Donnelley & Sons Company, Chicago, IL (US)

(72) Inventor: Marcellino Santoro, Jr., Bartlett, IL (US)

(73) Assignee: R. R. DONNELLEY & SONS COMPANY, Chicago, IL (US)

( * ) Notice: Subject to any disclaimer, the term of this patent is extended or adjusted under 35 U.S.C. 154(b) by 0 days. days.

(21) Appl. No.: 15/415,587

(22) Filed: Jan. 25, 2017

(65) Prior Publication Data

US 2017/0213485 A1 Jul. 27, 2017

Related U.S. Application Data

(60) Provisional application No. 62/286,963, filed on Jan. 25, 2016.

(51) Int. Cl.
*G09F 15/00* (2006.01)
*G09F 7/00* (2006.01)

(52) U.S. Cl.
CPC ..... *G09F 7/00* (2013.01)

(58) Field of Classification Search
CPC ..... G09F 1/06; G09F 1/065; G09F 15/0025; G09F 15/0062; A47F 5/112; A47F 5/11; Y10S 52/10
USPC ..... 40/610, 539; 248/175
See application file for complete search history.

(56) References Cited

U.S. PATENT DOCUMENTS

| | | | |
|---|---|---|---|
| 822,841 | A | 6/1906 | Hill |
| 956,916 | A | 5/1910 | Wiederseim, Jr. |
| 1,028,147 | A | 6/1912 | Stranders |
| 1,545,771 | A | 7/1925 | Hout |
| 1,576,672 | A | 3/1926 | Miller |
| 1,656,341 | A | 1/1928 | Smith |
| 1,670,464 | A | 5/1928 | Marsh |
| 1,687,616 | A | 10/1928 | Huye |

(Continued)

FOREIGN PATENT DOCUMENTS

| | | |
|---|---|---|
| CN | 203192354 | 9/2013 |
| DE | 2658506 | 1/1978 |

(Continued)

OTHER PUBLICATIONS

United States Patent and Trademark Office, "Non-Final Office Action," issued in connection with U.S. Appl. No. 14/709,266, dated May 23, 2016, 32 pages.

(Continued)

*Primary Examiner* — Shin H Kim
(74) *Attorney, Agent, or Firm* — Hanley, Flight and Zimmerman, LLC

(57) ABSTRACT

Self-erectable displays and methods of making such self-erectable displays are disclosed herein. An example apparatus includes a first panel, a second panel, and a third panel. In this example, in an erected position, the first panel, the second panel, and the third panel form a triangular cross-section. The example apparatus also includes a stop that extends between a base of one of the first panel, the second panel, or the third panel and a vertex of the others of the first panel and the second panel, the first panel and the third panel, or the second panel and the third panel. The example stop prevents movement of the vertex toward the base.

23 Claims, 35 Drawing Sheets

(56) References Cited

U.S. PATENT DOCUMENTS

| | | | |
|---|---|---|---|
| 1,902,566 | A | 3/1933 | Marsh |
| 2,108,349 | A | 2/1938 | Rasmussen |
| 2,113,288 | A | 4/1938 | Berger |
| 2,142,826 | A | 1/1939 | Rosello |
| 2,153,460 | A | 4/1939 | Giles |
| 2,210,317 | A | 8/1940 | Dueringer |
| 2,283,406 | A | 5/1942 | Bacon |
| 2,290,144 | A | 7/1942 | Katz |
| 2,404,089 | A | 7/1946 | Pollock |
| 2,601,374 | A | 6/1952 | Ditsler et al. |
| 2,637,924 | A | 5/1953 | Hutt |
| 2,728,461 | A | 12/1955 | Paige |
| 2,773,324 | A | 12/1956 | Drueck, Jr. |
| 2,833,074 | A | 5/1958 | Jannes |
| 2,892,276 | A | 6/1959 | Nelson |
| 2,918,178 | A | 12/1959 | Leone |
| 2,984,920 | A | 5/1961 | Acosta et al. |
| 3,015,898 | A | 1/1962 | Keeslar |
| 3,091,877 | A | 6/1963 | Luchsinger |
| 3,234,682 | A | 2/1966 | Frankl |
| 3,267,597 | A | 8/1966 | Jannes |
| 3,302,321 | A | 2/1967 | Walker |
| 3,571,958 | A | 3/1971 | Stevens et al. |
| 3,665,669 | A | 5/1972 | Huber |
| 3,666,607 | A | 5/1972 | Weissman |
| 4,234,148 | A | 11/1980 | Maddestra et al. |
| 4,610,363 | A | 9/1986 | Flum et al. |
| 4,619,426 | A | 10/1986 | Drueck, Jr. |
| 4,750,283 | A | 6/1988 | Halpern |
| 4,770,379 | A | 9/1988 | Estvold |
| 4,773,622 | A | 9/1988 | Herlin |
| 4,774,780 | A | 10/1988 | Crowell |
| 4,790,714 | A | 12/1988 | Schnapp |
| 4,854,060 | A | 8/1989 | Corbo et al. |
| 4,940,199 | A | 7/1990 | Hall |
| 4,984,848 | A | 1/1991 | Scalisi et al. |
| 4,993,846 | A | 2/1991 | Diamond et al. |
| 5,000,717 | A | 3/1991 | Pfeiffer |
| 5,193,466 | A | 3/1993 | Eder |
| 5,197,631 | A | 3/1993 | Mishima |
| 5,297,677 | A | 3/1994 | Burian et al. |
| 5,416,997 | A | 5/1995 | Dyment et al. |
| 5,454,180 | A | 10/1995 | Volpe |
| 5,467,547 | A | 11/1995 | Fortner |
| 5,632,390 | A | 5/1997 | Podergois |
| 5,752,649 | A | 5/1998 | Weder |
| 5,758,438 | A | 6/1998 | Crowell |
| 5,778,959 | A | 7/1998 | Guetschow |
| 5,787,621 | A | 8/1998 | Leksell |
| 5,809,673 | A | 9/1998 | Johnson et al. |
| 5,868,367 | A | 2/1999 | Smith |
| 5,878,945 | A | 3/1999 | Weder |
| 5,937,553 | A | 8/1999 | Maran |
| 5,966,857 | A | 10/1999 | Pettersson et al. |
| 5,983,538 | A | 11/1999 | Crowell |
| 6,311,418 | B1 | 11/2001 | Crowell |
| 6,347,772 | B1 | 2/2002 | L'Hôtel |
| 6,497,601 | B1 | 12/2002 | Ward |
| 7,134,230 | B1 | 11/2006 | Boens et al. |
| 7,159,350 | B2 | 1/2007 | L'Hotel |
| 7,234,253 | B2 | 6/2007 | Ossmann |
| 7,437,842 | B2 | 10/2008 | Sgambellone |
| 7,634,865 | B2 | 12/2009 | L'Hôtel |
| 7,726,054 | B2 | 6/2010 | Mestres Armengol et al. |
| 7,774,964 | B2 | 8/2010 | L'Hôtel |
| 7,980,013 | B2 | 7/2011 | Hsu |
| 8,099,883 | B2 | 1/2012 | Mestres Armengol et al. |
| 8,112,925 | B2 | 2/2012 | Tzuo |
| 8,291,631 | B2 | 10/2012 | Wilder |
| 8,458,939 | B2 | 6/2013 | Arthur et al. |
| 8,590,188 | B2 | 11/2013 | Mirsch |
| 8,701,321 | B2 | 4/2014 | Da Fonseca et al. |
| 8,776,415 | B2 | 7/2014 | Kawaguchi et al. |
| 8,826,833 | B1 | 9/2014 | Fischer et al. |
| 8,863,418 | B2 | 10/2014 | Acker et al. |
| 8,875,908 | B2 | 11/2014 | L'Hôtel |
| 9,173,485 | B2 | 11/2015 | Fischer et al. |
| 9,715,840 | B1 | 7/2017 | Warmus |
| 2004/0111930 | A1 | 6/2004 | Ossmann |
| 2008/0066353 | A1 | 3/2008 | Mills |
| 2008/0083146 | A1 | 4/2008 | Martin Presa |
| 2010/0072330 | A1 | 3/2010 | Tzuo |
| 2010/0236117 | A1 | 9/2010 | Mestres Armengol et al. |
| 2011/0088300 | A1 | 4/2011 | Martin Presa |
| 2011/0179685 | A1 | 7/2011 | Mirsch |
| 2012/0012734 | A1 | 1/2012 | Tzuo |
| 2012/0227297 | A1 | 9/2012 | Kawaguchi et al. |
| 2013/0219760 | A1 | 8/2013 | Acker et al. |
| 2014/0265777 | A1 | 9/2014 | Fischer et al. |
| 2016/0335925 | A1 | 11/2016 | Ruhaak |
| 2016/0335934 | A1 | 11/2016 | Lyon |
| 2016/0335935 | A1 | 11/2016 | Lyon |
| 2017/0193866 | A1 | 7/2017 | Bonifas |
| 2017/0294149 | A1 | 10/2017 | Lyon |
| 2018/0040262 | A1 | 2/2018 | Lyon |
| 2018/0075781 | A1 | 3/2018 | Cwidak et al. |
| 2018/0075788 | A1 | 3/2018 | Warmus et al. |

FOREIGN PATENT DOCUMENTS

| | | |
|---|---|---|
| DE | 4005925 | 10/1991 |
| DE | 4314654 | 11/1994 |
| DE | 9320993 | 8/1995 |
| DE | 202010015312 | 1/2011 |
| DE | 202011002980 | 4/2011 |
| DE | 202014106297 | 3/2015 |
| DK | 9500055 | 5/1995 |
| DK | 9500277 | 9/1995 |
| EP | 1741368 | 1/2007 |
| EP | 1830334 | 9/2007 |
| EP | 1926076 | 5/2008 |
| EP | 2290637 | 3/2011 |
| EP | 2400477 | 12/2011 |
| ES | 2212927 | 8/2004 |
| ES | 2255857 | 7/2006 |
| FR | 1254983 | 3/1961 |
| FR | 2210317 | 7/1974 |
| FR | 2232259 | 12/1974 |
| FR | 2233912 | 1/1975 |
| FR | 2571949 | 4/1986 |
| FR | 2574968 | 6/1986 |
| FR | 2650907 | 2/1991 |
| FR | 2680030 | 2/1993 |
| FR | 2691621 | 12/1993 |
| FR | 2730148 | 8/1996 |
| FR | 2735264 | 12/1996 |
| FR | 2745109 | 8/1997 |
| FR | 2760801 | 9/1998 |
| FR | 2760802 | 9/1998 |
| FR | 2760880 | 9/1998 |
| FR | 2770320 | 4/1999 |
| FR | 2911425 | 7/2008 |
| FR | 2925203 | 6/2009 |
| FR | 2925204 | 6/2009 |
| FR | 2948222 | 1/2011 |
| GB | 463574 | 4/1937 |
| GB | 740577 | 11/1955 |
| GB | 743378 | 1/1956 |
| GB | 824004 | 11/1959 |
| GB | 1034280 | 6/1966 |
| GB | 1272187 | 4/1972 |
| GB | 1317155 | 5/1973 |
| WO | 9634379 | 10/1996 |
| WO | 9936900 | 7/1999 |
| WO | 2002095719 | 11/2002 |
| WO | 2004044867 | 5/2004 |
| WO | 2006040438 | 4/2006 |
| WO | 2006067252 | 6/2006 |
| WO | 2007138083 | 12/2007 |
| WO | 2008049176 | 5/2008 |
| WO | 2010019086 | 2/2010 |
| WO | 2010130485 | 11/2010 |
| WO | 2011092209 | 8/2011 |

(56) References Cited

FOREIGN PATENT DOCUMENTS

| | | |
|---|---|---|
| WO | 2011113123 | 9/2011 |
| WO | 2012061375 | 5/2012 |
| WO | 2016057067 | 4/2016 |

OTHER PUBLICATIONS

United States Patent and Trademark Office, "Notice of Allowance," issued in connection with U.S. Appl. No. 14/709,266, dated Sep. 26, 2016, 31 pages.
United States Patent and Trademark Office, "Non-Final Office Action," issued in connection with U.S. Appl. No. 14/709,285, dated Sep. 15, 2016, 38 pages.
United States Patent and Trademark Office, "Non-Final Office Action," issued in connection with U.S. Appl. No. 14/711,739, dated Sep. 16, 2016, 91 pages.
United States Patent and Trademark Office, "Non-Final Office Action," issued in connection with U.S. Appl. No. 15/229,920, dated Dec. 1, 2016, 9 pages.
International Searching Authority, "International Search Report and Written Opinion," issued in connection with International Patent Application No. PCT/US2016/064478, dated Jan. 24, 2017, 15 pages.
United States Patent and Trademark Office, "Final Office Action," issued in connection with U.S. Appl. No. 14/711,739, dated Mar. 21, 2017, 19 pages.
United States Patent and Trademark Office, "Non-final Office Action," issued in connection with U.S. Appl. No 14/988,616, dated Apr. 11, 2017, 36 pages.
United States Patent and Trademark Office, "Notice of Allowance," issued in connection with U.S. Appl. No. 14/709,266, dated Apr. 12, 2017, 17 pages.
United States Patent and Trademark Office, "Notice of Allowance," issued in connection with U.S. Appl. No. 14/709,285, dated Jul. 3, 2017, 19 pages.
United States Patent and Trademark Office, "Office Action," issued in connection with U.S. Appl. No. 14/709,285, dated Mar. 15, 2017, 24 pages.
United States Patent and Trademark Office, "Notice of Allowance," issued in connection with U.S. Appl. No. 15/229,920, dated Mar. 22, 2017, 43 pages.
United States Patent and Trademark Office, "Office Action," issued in connection with U.S. Appl. No. 15/261,178, dated Sep. 29, 2017, 46 pages.
International Searching Authority, "International Search Report," issued in connection with PCT Patent Application No. PCT/US2017/045471, dated Oct. 18, 2017, 5 pages.
International Searching Authority, "Written Opinion," issued in connection with PCT Patent Application No. PCT/US2017/045471, dated Oct. 18, 2017, 6 pages.
United States Patent and Trademark Office, "Notice of Allowance," issued in connection with U.S. Appl. No. 14/988,616, dated Feb. 28, 2018, 8 pages.
United States Patent and Trademark Office, "Non- Final Office action," issued in connection with U.S. Appl. No. 15/634,974, dated Apr. 9, 2018, 11 pages.

SELF-ERECTABLE DISPLAYS AND METHODS OF MAKING SUCH SELF-ERECTABLE DISPLAYS

RELATED DISCLOSURE

This patent arises from a U.S. Provisional Patent Application No. 62/286,963 filed Jan. 25, 2016. Priority is claimed to U.S. Provisional Patent Application No. 62/286,963. U.S. Provisional Patent Application No. 62/286,963 is hereby incorporated herein by reference in its entirety.

FIELD OF THE DISCLOSURE

This disclosure relates generally to displays and, more particularly, to self-erectable displays and methods of making such self-erectable displays.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
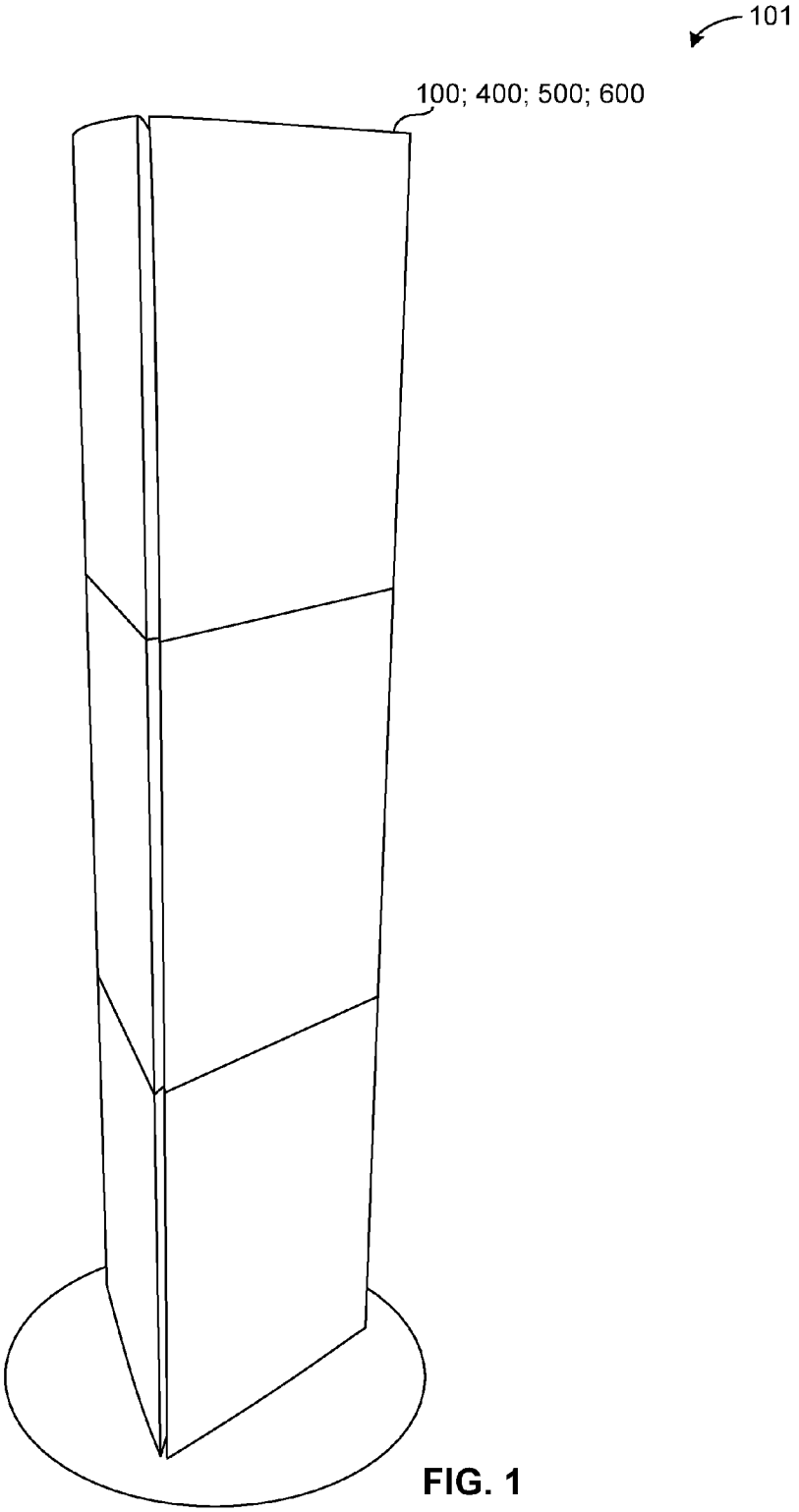
FIG. 1 is a perspective view of an example self-erectable display in accordance with the teachings of this disclosure.

The examples disclosed herein relate to self-erectable displays that can be used for point-of-sale advertising, providing information, or for other suitable purposes. In some examples, the example self-erectable displays may be shipped to a customer in a folded, flat state. The example displays may include one or more elastic band(s) that are in a state of tension when the display is in the folded, flat state because forces imparted by the folded material of the display are greater than a force exerted by the elastic band(s). However, when the display is unfolded, the force being imparted on the elastic band(s) is less than the force exerted by the elastic band(s), thereby enabling the elastic band(s) to urge the display from the folded position to the erected position. Thus, using the examples disclosed herein, an individual can erect the example displays with little if any instruction and/or training.

In some examples and as illustrated in the examples of FIGS. 1, 2, 3 and 9-30, an example shroud 100 of an example self-erectable display 101 is formed using first and second example elongate substrates 104, 106 where the first substrate 104 is a mirror image of the second substrate 106. In some examples, the first elongate substrate 104 includes a first flap 108 along a first side edge 110, a first panel 112, a first sub-panel 114 and a second flap 116 including an example first stop 118 along a second side edge 120. In some examples, the first panel 112 is disposed between the first flap 108 and the first sub-panel 114 and defined by lines of weakness 150, 152 and the first sub-panel 114 is disposed between the first panel 112 and the second flap 116 and defined by lines of weakness 152, 154. In this example, when the first elongate substrate 104 is folded to form the self-erectable display, the first flap 108 and the second flap 116 are inward facing.

In some examples, the second elongate substrate 106 includes a third flap 122 along a third side edge 124, a third panel 126, a second sub-panel 128 and a fourth flap 130 including an example second stop 132 along a fourth side edge 134. In some examples, the third panel 126 is disposed between the third flap 122 and the second sub-panel 128 and defined by lines of weakness 156, 158, and the second sub-panel 128 is disposed between the third panel 126 and the fourth flap 130 and defined by lines of weakness 158, 160. In this example, when the second elongate substrate 106 is folded to form the self-erectable display, the third flap 122 and the fourth flap 130 are inward facing.

To form the example shroud 100, the first and third flaps 108, 122 are coupled and the second and fourth flaps 116, 130 are coupled. In some examples and as shown in the illustrated example of FIG. 2, the first and third flaps 108, 122 are coupled using biasing elements, elastic bands and/or rubber bands 202 (e.g., FIG. 2) that longitudinally extend along the first and third flaps 108, 122 between eyelets and/or apertures 302, 303, 304, 305, 306, 307, 308, 310, 312, 314, 316, 318, 320 (e.g., FIGS. 3, 25). In some examples, the second and fourth flaps 116, 130 are coupled using biasing elements, elastic bands and/or rubber bands 204 (e.g., FIG. 2) that longitudinally extend along the second and fourth flaps 116, 130 between eyelets and/or apertures 322, 324, 326, 327, 328, 330, 332, 334, 336, 338, 340, 342 (e.g., FIGS. 3, 23).

Figure 2:
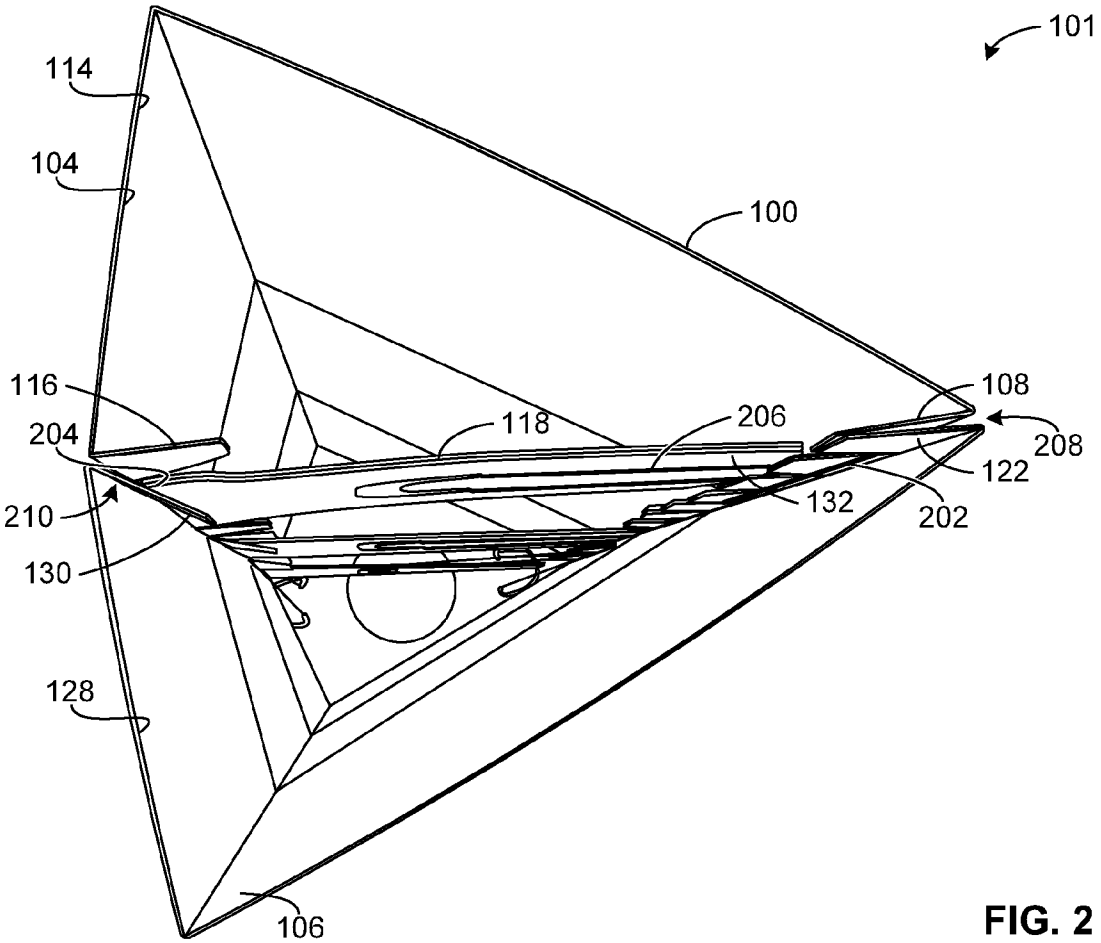
FIG. 2 is a top view of an example self-erectable display that can be used to implement the example self-erectable display of FIG. 1.

In some examples, coupling the second and fourth flaps 116, 130 couples the first and second stops 118, 132. In other examples, the flaps 116, 130 are coupled using adhesive, etc. In some examples and as illustrated in the example of FIG. 2, coupling the second and fourth flaps 116, 130 enables the first sub-panel 114 to be immediately adjacent to the second-sub-panel 128 such that a combined width of the first sub-panel 114 and the second sub-panel 128 is approximately equal to the width of the first panel 112. In some examples, coupling the second and fourth flaps 116, 130 enables the first sub-panel 114 to be immediately adjacent to the second-sub-panel 128 such that a combined width of the first sub-panel 114 and the second sub-panel 128 is approximately equal to the width of the third panel 126. In other words, in some examples and as illustrated in the example of FIG. 2, when the first and second substrates 104, 106 are coupled, the first panel 112, the first sub-panel 114, the second sub-panel 128 and the third panel 126 form an equilateral triangle. In other examples, the first panel 112, the first sub-panel 114, the second sub-panel 128 and the third panel 126 form an isosceles triangle or have another cross-section.

Figure 3A:
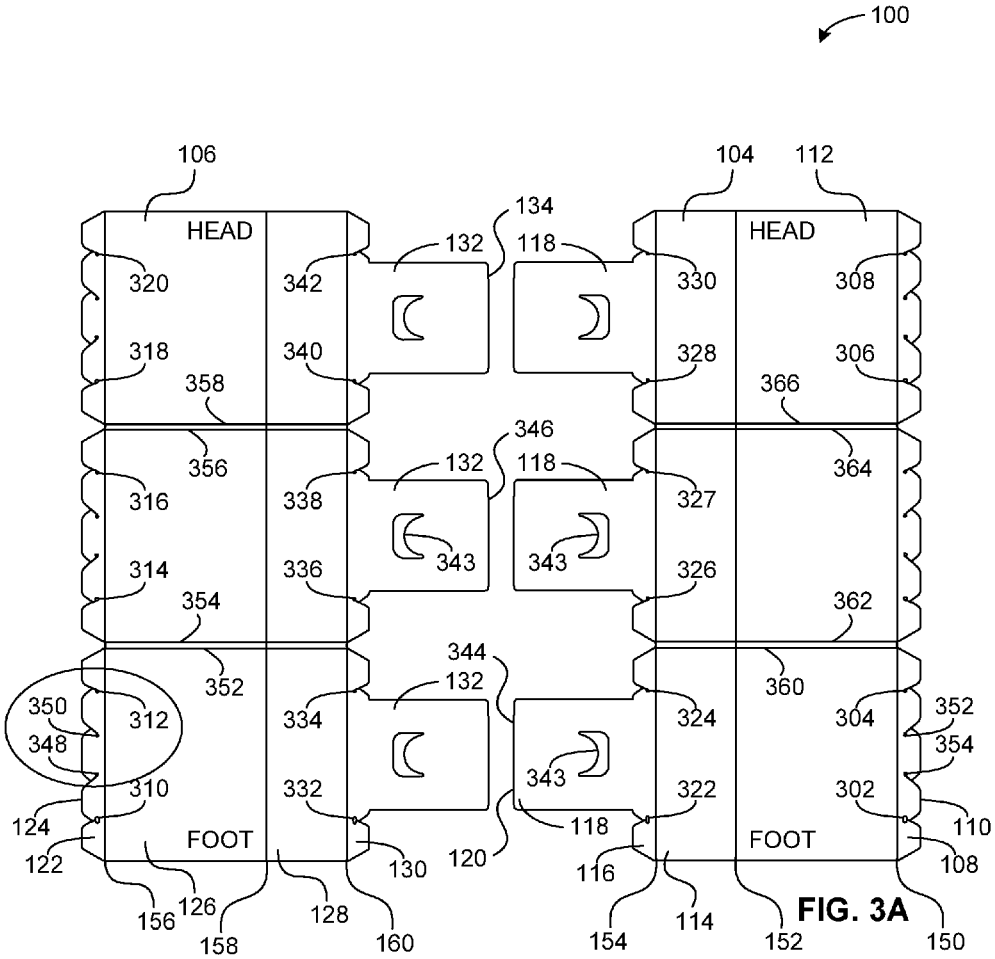
FIG. 3A illustrates a plan view of first example shrouds and/or substrates in a flat state that can be used to implement the example self-erectable display of FIG. 1.
Figure 3B:
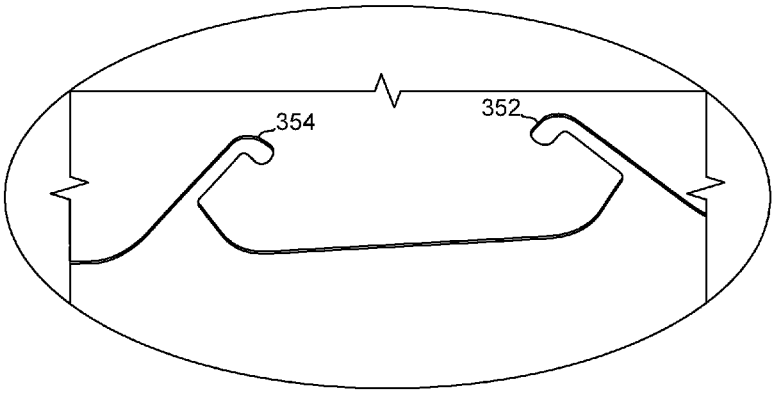
FIG. 3B illustrates example eyelets that can be used to implement the example self-erectable display of FIG. 3A.
Figure 4:
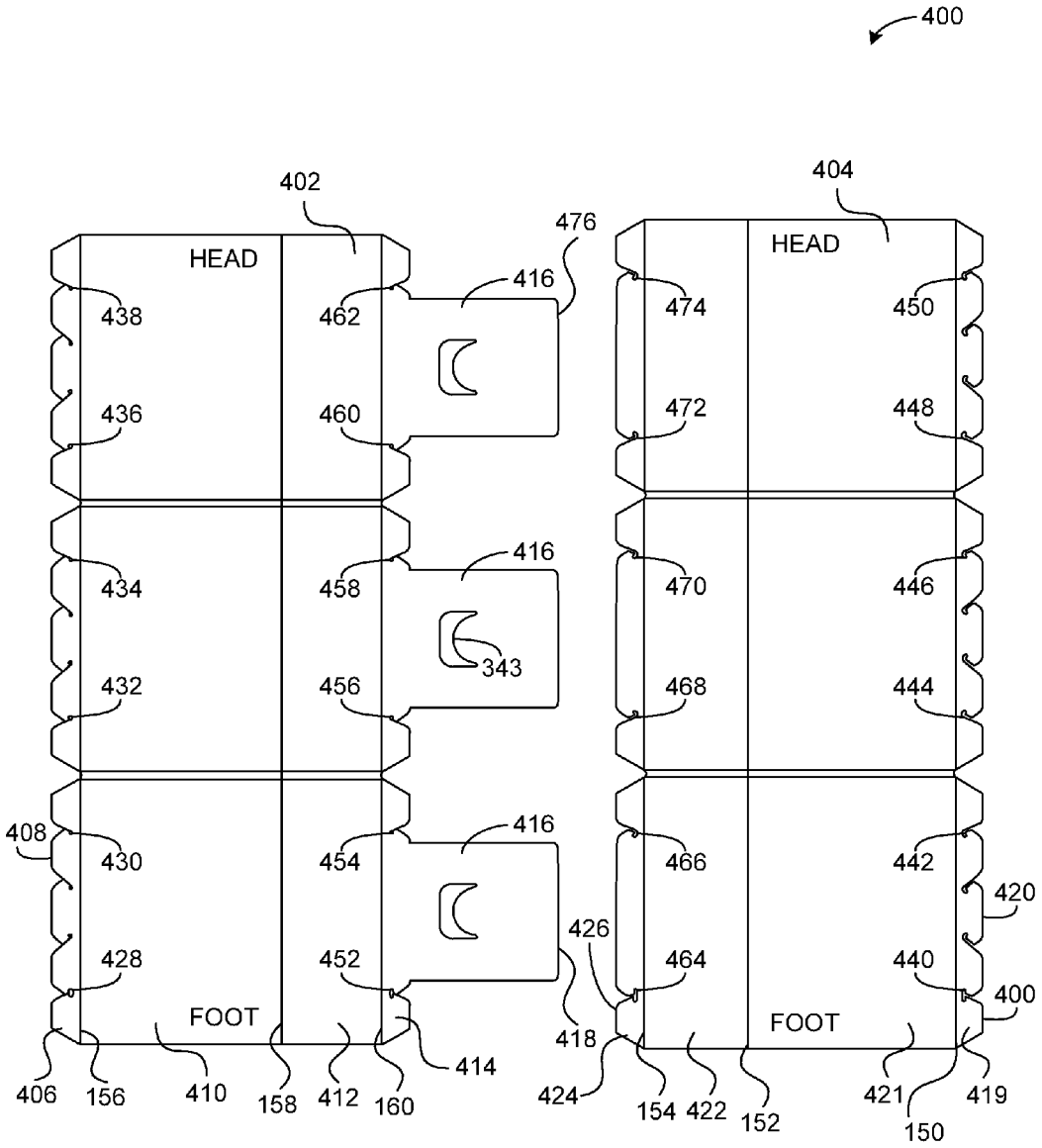
FIG. 4 illustrates a plan view of second example shrouds and/or substrates in a flat state that can be used to implement the example self-erectable display of FIG. 1.

In some examples, to urge the example self-erectable display toward the erected position, biasing elements, elastic bands and/or rubber bands 206 (e.g., FIG. 2) are coupled between the first and second stops 118, 132 and the first flap 108 and/or the third flap 122 within eyelets and/or apertures 348, 349, 350, 351. A detailed illustration of these apertures 352, 354 are shown in FIG. 3B. In the example shown in FIG. 3A, the stops 118, 132 define apertures 343 to receive and/or couple the rubber bands 206 to the stops 118, 132. In this example, the apertures 343 are moon-shaped and include notches to retain the rubber bands 206 relative to the stops 118, 132. However, the apertures 343 may be different shapes and/or the rubber bands 206 may be coupled in different ways.

As shown in the example of FIG. 2, the biasing element 206 extends between a vertex 208 of the self-erectable display 102 and an opposing side of the self-erectable base including the first sub-panel 114 and the second sub-panel 128. In some examples, the coupling between the first and second stops 118, 132 and the first and/or third flaps 108, 122 urges an end 344 of the first stop 118 and/or an end 346 of the second stop 132 into the vertex 208 formed by the coupling of the first and third panels 112, 126. In some examples, the biasing elements, elastic bands and/or rubber bands 206 act as a guide that guides the ends 344, 346 of the first and/or second stops 118, 132 to not directly engage an end 110 of the first flap 108 or an end 124 of the third flap 122. While the above example describes the first and second stops 118, 132 being formed on the second and fourth flaps 116, 130, in other examples, the first and second stops 118, 132 are formed on the first and third flaps 108, 122. In such examples, an end of the first and second stops extends toward an intersection 210 between the first sub-panel 114 and the second sub-panel 128.

In other examples and as illustrated in the examples of FIGS. 1, 4 and 9-13, an example shroud 400 of an example self-erectable display is formed using first and second example elongate substrates 402, 404. In some examples, the first elongate substrate 402 includes a first flap 406 along a first side edge 408, a first panel 410, a first sub-panel 412 and a second flap 414 including an example stop 416 along a second side edge 418. In some examples, the first panel 410 is disposed between the first flap 406 and the first sub-panel 412 and the first sub-panel 412 is disposed between the first panel 410 and the second flap 414. In this example, when the first elongate substrate 402 is folded to form the self-erectable display, the first flap 406 and the second flap 414 are inward facing.

In some examples, the second elongate substrate 404 includes a third flap 419 along a third side edge 420, a third panel 421, a second sub-panel 422 and a fourth flap 424 along a fourth side edge 426. In some examples, the third panel 421 is disposed between the third flap 419 and the second sub-panel 422 and the second sub-panel 422 is disposed between the third panel 421 and the fourth flap 424. In this example, the second flap 414 includes the example stop 416, but the fourth flap 424 does not include a stop. In this example, when the second elongate substrate 404 is folded to form the self-erectable display, the third flap 419 and the fourth flap 424 are inward facing.

To form the example shroud 400, the first and third flaps 406, 419 are coupled and the second and fourth flaps 414, 424 are coupled. In some examples, the first and third flaps 406, 419 are coupled using biasing elements, elastic bands and/or rubber bands that longitudinally extend along the first and third flaps 406, 419 between eyelets and/or apertures 428, 430, 432, 434, 436, 438, 440, 442, 444, 446, 448, 450. In some examples, the second and fourth flaps 414, 424 are coupled using biasing elements, elastic bands and/or rubber bands that longitudinally extend along the second and fourth flaps 414, 424 between eyelets and/or apertures 452, 454, 456, 458, 460, 462, 464, 466, 468, 470, 472, 474. In other examples, the flaps are coupled using adhesive, etc.

In some examples, coupling the second and fourth flaps 414, 424 enables the first sub-panel 412 to be immediately adjacent to the second-sub-panel 422 such that a combined width of the first sub-panel 412 and the second sub-panel 422 is approximately the width of the first panel 410. In some examples, coupling the second and fourth flaps 414, 424 enables the first sub-panel 412 to be immediately adjacent to the second-sub-panel 422 such that a combined width of the first sub-panel 412 and the second sub-panel 422 is approximately equal to the width of the third panel 421. In other words, in some examples, when the first and second substrates 402, 404 are coupled, the first panel 410, the first sub-panel 412, the second sub-panel 422 and the third panel 421 form an equilateral triangle. In other examples, the first panel 410, the first sub-panel 412, the second sub-panel 422 and the third panel 421 form an isosceles triangle or have another cross-section.

In some examples, to urge the example self-erectable display toward the erected position, biasing elements, elastic bands and/or rubber bands are coupled between the stop 416 and the first flap 406 and/or the third flap 419. In some examples, the coupling between the stop 416 and the first and/or third flaps 406, 419 urges an end 476 of the stop 416 into a vertex formed by the coupling of the first and second substrates 402, 404. In some examples, to urge the example self-erectable display toward the erected position, biasing elements, elastic bands and/or rubber bands are coupled between the second flap 414, the stop 416 and/or the fourth flap 424 and the first flap 406 and/or the third flap 419. While the above example describes the stop 416 being formed on the second flap 414, in other examples, the stop 416 is formed on the first flap 406. In such examples, an end of the stop extends toward an intersection between the first sub-panel 412 and the second sub-panel 422.

In other examples and as illustrated in the examples of FIGS. 1, 5 and 10-14, an example shroud 500 of an example self-erectable display is formed using first and second example elongate substrates 502, 504 and an example couplable stop 506. In some examples, the first and second substrates 502, 504 are mirror images of one another. In some examples, the first elongate substrate 502 includes a first flap 508 along a first side edge 510, a first panel 512, a first sub-panel 514 and a facing flap 516 along a second side edge 518. In some examples, the first panel 512 is disposed between the first flap 508 and the first sub-panel 514 and the first sub-panel 514 is disposed between the first panel 512 and the second flap 516. In this example, when the first elongate substrate 502 is folded to form the self-erectable display, the first flap 508 and the second flap 516 are inward facing.

In some examples, the second elongate substrate 504 includes a third flap 520 along a third side edge 522, a third panel 524, a second sub-panel 526 and a fourth flap 528 along a fourth side edge 530. In some examples, the third panel 524 is disposed between the third flap 520 and the second sub-panel 526 and the second sub-panel 526 is disposed between the third panel 524 and the fourth flap 528. In this example, the second flap 516 and the fourth flap 528 do not include integral stops. Also in this example, when the second elongate substrate 504 is folded to form the self-erectable display, the third flap 520 and the fourth flap 528 are inward facing.

Figure 5:
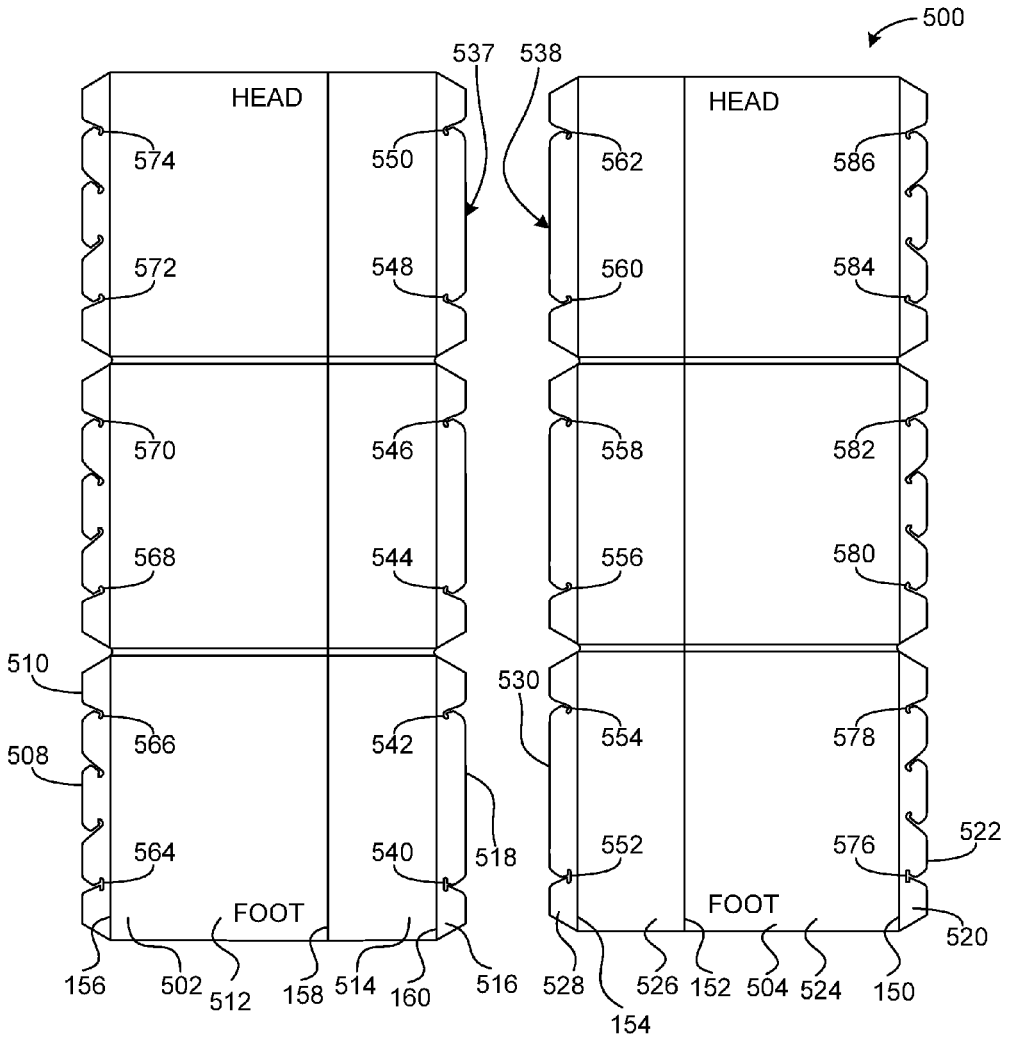
FIG. 5 illustrates a plan view of third example shrouds and/or substrates and an example stop in a flat state that can be used to implement the example self-erectable display of FIG. 1.
Figure 5:
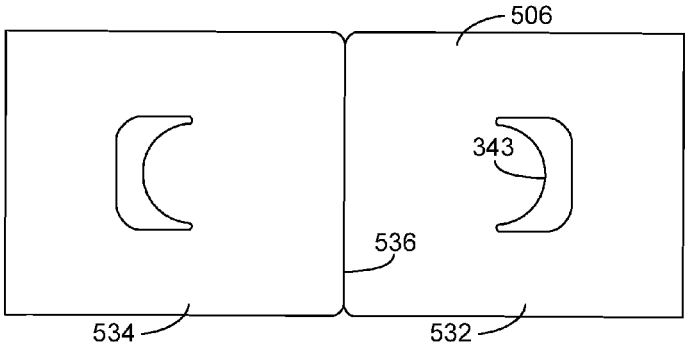

To form the example shroud 500, the second and fourth flaps 516, 528 are coupled and the example stop 506 is coupled to the second flap 516 and/or to the fourth flap 528. In some examples, the example stop 506 is formed of a single panel that is not folded. In other examples and as shown in the example of FIG. 5, the example stop 506 is formed of a first stop panel 532 and a second stop panel 534 where the second stop panel 534 is coupled to the first stop panel 532 at a fold line 536. In some examples, the first stop panel 532 is coupled to the second flap 516 and the second stop panel 534 is coupled to the fourth flap 528 such that the fold line 536 of the stop 506 extends away from the second and fourth flaps 516, 528. In some examples, the second and fourth flaps 516, 528 include an eyelet-free area 537, 538 along which the example stop 506 is to be coupled.

In some examples, the second and fourth flaps 516, 528 are coupled using biasing elements, elastic bands and/or rubber bands that longitudinally extend along the second and fourth flaps 516, 528 between eyelets and/or apertures 540, 542, 544, 546, 548, 550, 552, 554, 556, 558, 560, 562. In other examples, the flaps 516, 528 are coupled using adhesive, etc. In some examples, coupling the second and fourth flaps 516, 528 enables the first sub-panel 514 to be immediately adjacent to the second-sub-panel 526 such that a combined width of the first sub-panel 514 and the second sub-panel 526 is approximately equal to the width of the first panel 512. In some examples, coupling the second and fourth flaps 516, 528 enables the first sub-panel 514 to be immediately adjacent to the second-sub-panel 526 such that a combined width of the first sub-panel 514 and the second sub-panel 526 is approximately equal to the width of the third panel 524. In other words, in some examples, when the first and second substrates 502, 504 are coupled, the first panel 512, the first sub-panel 514, the second sub-panel 526 and the third panel 524 form an equilateral triangle. In other examples, the first panel 512, the first sub-panel 514, the second sub-panel 526 and the third panel 524 form an isosceles triangle or have another cross-section.

Further, to form the example shroud 500, the first and third flaps 508, 520 are coupled. In some examples, the first and third flaps 508, 520 are coupled using biasing elements, elastic bands and/or rubber bands that longitudinally extend along the first and third flaps 508, 520 between eyelets and/or apertures 564, 566, 568, 570, 572, 574, 576, 578, 580, 582, 584, 586.

In some examples, to urge the example self-erectable display toward the erected position, biasing elements, elastic bands and/or rubber bands are coupled between the stop 506 and the first flap 508 and/or the third flap 520. In the illustrated example of FIG. 5, the biasing element may be received in the aperture 343 to couple the biasing element to the stop 506. In some examples, the coupling between the stop 506 and the first and/or third flaps 508, 520 urges an end (e.g., the fold 536) of the stop into a vertex formed by the coupling of the first and second panels 512, 524. In some examples, to urge the example self-erectable display toward the erected position, biasing elements, elastic bands and/or rubber bands are coupled between the first flap 508 and/or the third flap 520 and the second flap 516 and/or the fourth flap 528 and/or the stop 506. While the above example describes the stop 506 being coupled to the second flap 516 and/or the fourth flap 528, in other examples, the stop 506 is coupled to the first flap 508 and/or the third flap 520. In such examples, an end (e.g., the fold 536) of the stop 506 extends toward an intersection between the first sub-panel 514 and the second sub-panel 526.

Figure 6:
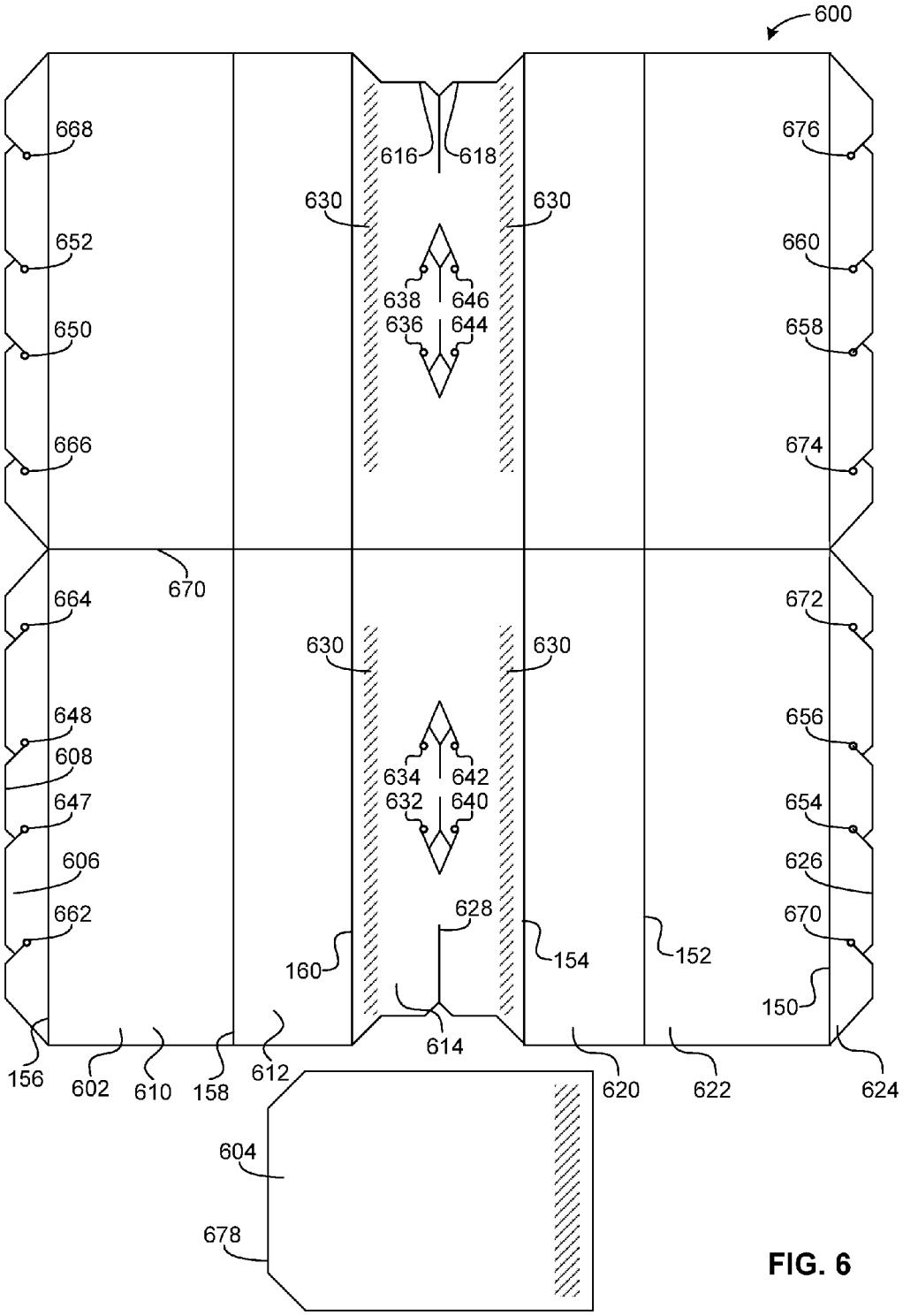
FIG. 6 illustrates a plan view of an example fourth shroud and/or substrate and an example stop in a flat state that can be used to implement the example self-erectable display of FIG. 1.

In other examples and as illustrated in the examples of FIGS. 1, 6 and 7, an example shroud 600 of an example self-erectable display is formed using a single substrate 602 and an example stop 604. In some examples, the elongate substrate 602 includes a first flap 606 along a first side edge 608, a first panel 610, a first sub-panel 612, a second flap 614 including a first sub-flap panel 616 and a second sub-flap panel 618, a second sub-panel 620, a third panel 622 and a third flap 624 along a second side edge 626. In some examples, the first panel 610 is disposed between the first flap 606 and the first sub-panel 612. In some examples, the first sub-panel 612 is disposed between the first panel 610 and the first sub-flap panel 616. In some examples, the first sub-flap panel 616 is coupled to the second sub-flap panel 618 along a fold line 628. In some examples, the third panel 622 is disposed between the third flap 624 and the second sub-panel 620. In some examples, the second sub-panel 620 is disposed between the third panel 622 and the second sub-flap panel 618. In this example, when the substrate 602 is folded to form the self-erectable display, the first flap 606, the second flap 614, and the third flap 624 are inward facing.

To form the example shroud 600, the first and second sub-flap panels 616, 618 are coupled to form the second flap 614 and the example stop 604 is coupled to the second flap 614. In some examples, the first and second sub-flap panels 616, 618 are coupled using adhesive 630 disposed on the first and/or second sub-flap panels 616, 618. In some examples, coupling the first and second sub-flap panels 616, 618 enables the first sub-panel 612 to be immediately adjacent to the second-sub-panel 620 such that a combined width of the first sub-panel 612 and the second sub-panel 620 is approximately equal to the width of the first panel 610.

In some examples, the example stop 604 is formed of a single panel. In other examples, the example stop 604 is formed of a first stop panel and a second stop panel where the second stop panel is coupled to the first stop panel at a fold line (e.g., the stop 506 of FIG. 5). In such examples, the first stop panel is coupled to one side of the second flap 614 and the second stop panel is coupled to the other side of the second flap 614 such that the fold line of the stop extends away from the second flap 614. In some examples, the first and second sub-flap panels 616, 618 include eyelets 632, 634, 636, 638, 640, 642, 644, 646 and/or the first and/or third flaps 108 and/or 122 647, 648, 650, 652, 654, 656, 658, 660 to enable the coupling of a biasing element and/or elastic band between the second flap 614 and the first flap 606 and/or the third flap 624.

Further, to form the example shroud 600, in some examples, the first and third flaps 606, 624 are coupled using biasing elements, elastic bands and/or rubber bands that longitudinally extend along the first and third flaps 606, 624 between eyelets and/or apertures 662, 664, 666, 668, 670, 672, 674, 676. In other examples, the flaps 606, 624 are coupled using adhesive, etc.

Figure 7A:
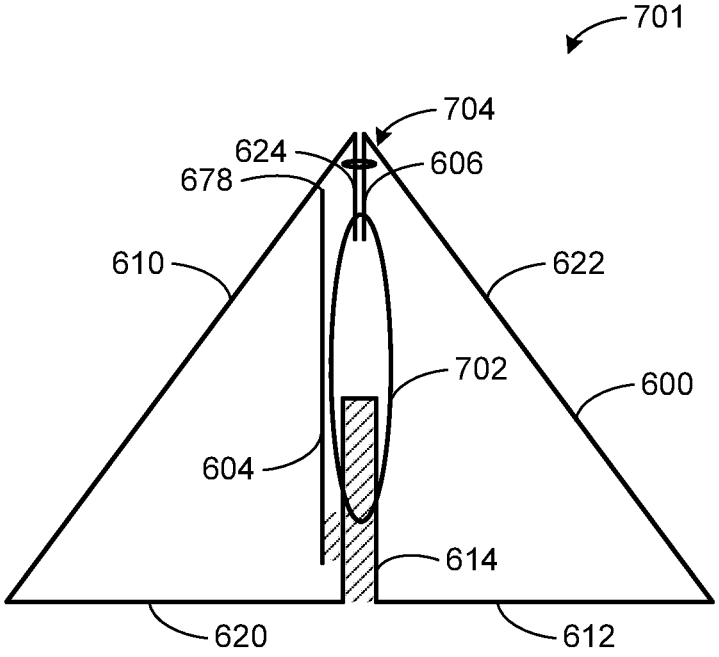
FIGS. 7A and 7B are top views of example self-erectable displays formed using the example shroud and/or substrate and the example stop of FIG. 6.
Figure 7B:
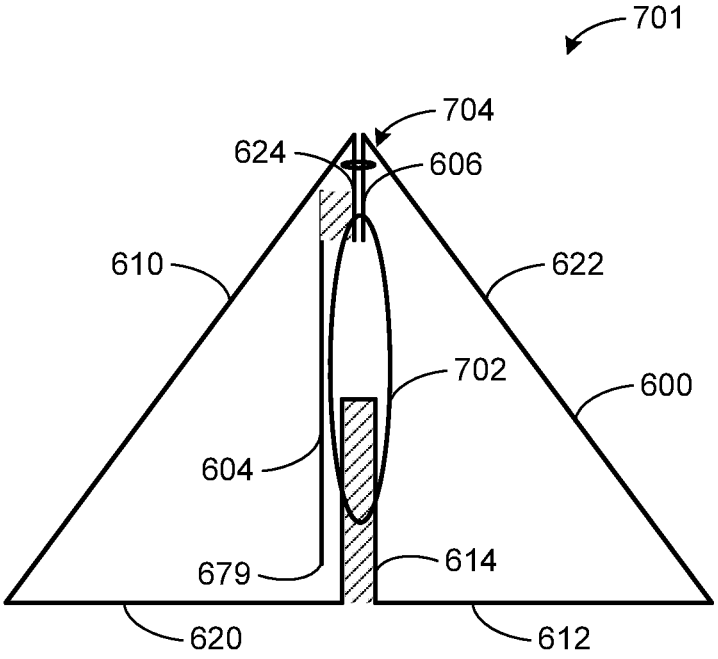

As illustrated in the example of FIGS. 7A and 7B, to urge an example self-erectable display 701 toward the erected position, biasing elements, elastic bands and/or rubber bands 702 are coupled between the second flap 614 and the first flap 606 and/or the third flap 624. Also, in some examples, the bands 702 are also coupled to the stop 604. In the example of FIG. 7A, the coupling between the stop 604 and/or the second flap 614 urges an end 678 of the stop 604 into a vertex 704 formed between the first and third panels 610, 622. In other examples and as shown in the example of FIG. 7B, the coupling between the stop 604 and the first and/or third flaps 606, 624 urges an end 679 of the stop 604 toward the second flap 614 and an intersection between the first sub-panel 612 and the second sub-panel 620.

Figure 8:
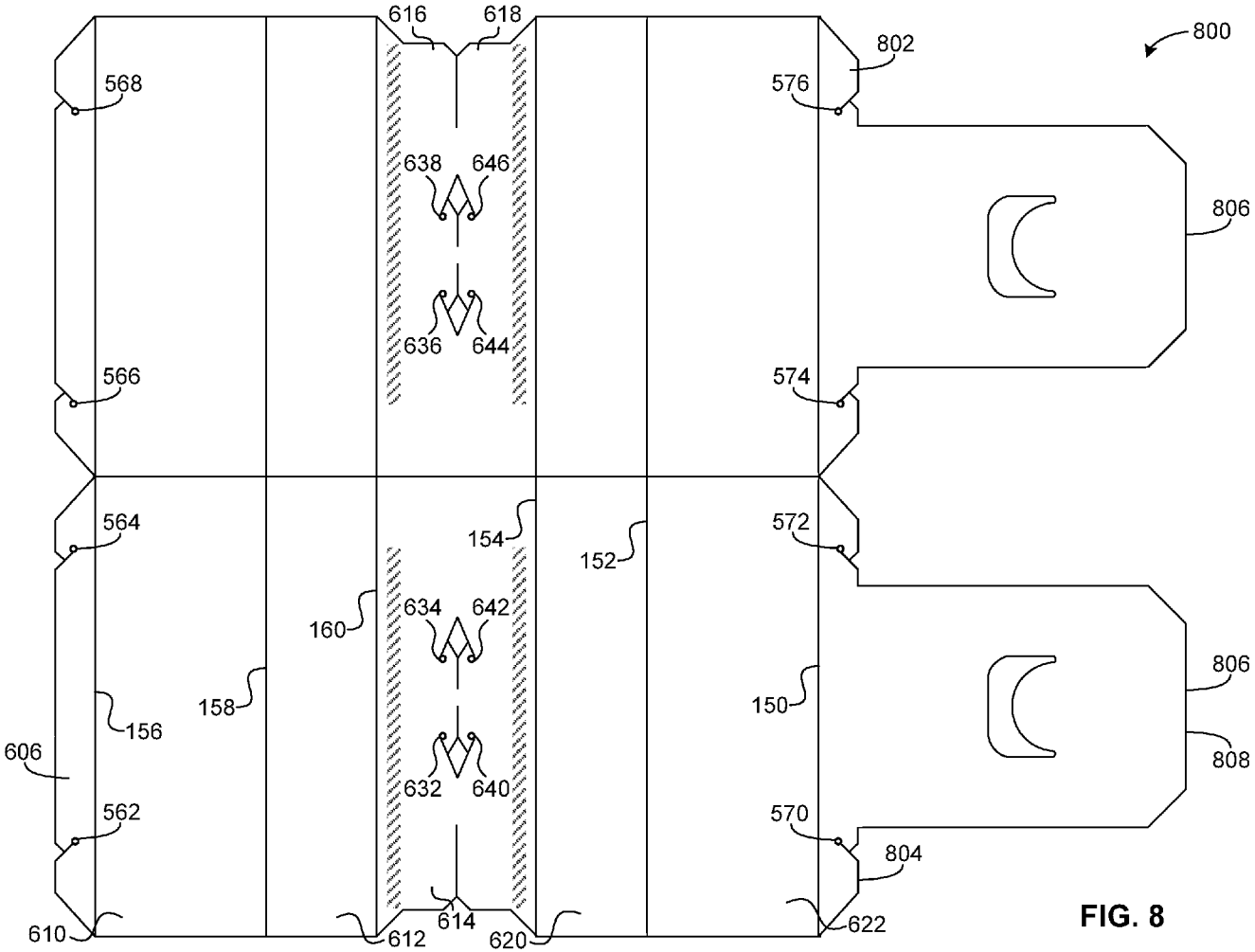
FIG. 8 illustrates a plan view of an example fifth shroud and/or substrate including example stops in a flat state that can be used to implement the example self-erectable display of FIG. 1.
Figure 9:
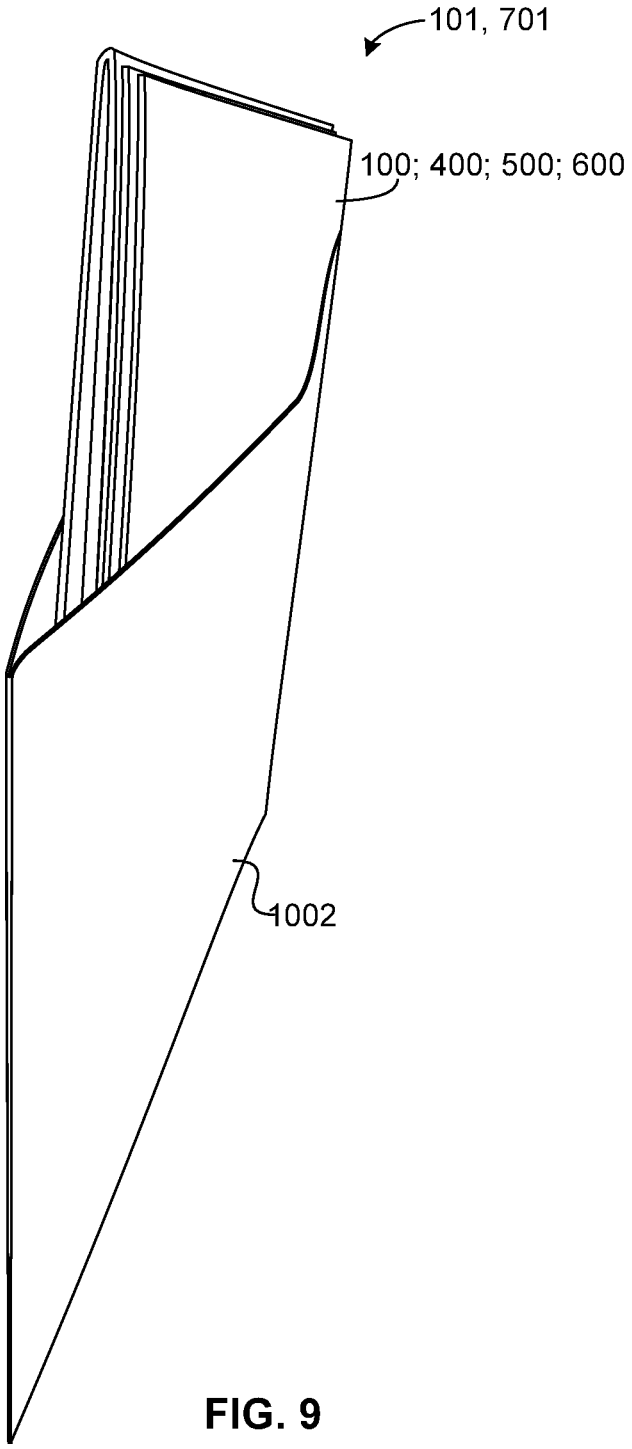
FIGS. 9-13 illustrate an example self-erectable display in accordance with the teachings of this disclosure progressing from a flat state to a deployed state.

The illustrated example of FIG. 8 depicts an example shroud 800 of an example self-erectable display that is similar to the examples illustrated in FIGS. 6 and 7. However, in contrast to the examples of FIGS. 6 and 7, the shroud 800 of FIG. 8 includes an elongate substrate 802 having a third flap 804 that includes an integral stop 806 extending therefrom (e.g., similar to the other integral stops disclosed herein).

In some examples, to urge the example self-erectable display toward the erected position, biasing elements, elastic bands and/or rubber bands are coupled between the stop 806 and the second flap 614. In some examples, the coupling between the stop 806 and the second flap 614 urges an end 808 of the stop 806 toward an intersection between the first sub-panel 616 and the second sub-panel 618. In some examples, to urge the example self-erectable display toward the erected position, biasing elements, elastic bands and/or rubber bands are coupled between the second flap 614 and the first flap 606 and/or the third flap 804. While the above example describes the stop 806 being coupled to the third flap 804, in other examples, the stop 806 is coupled to and/or formed from the second flap 614 and/or the first flap 606.

Figure 10:
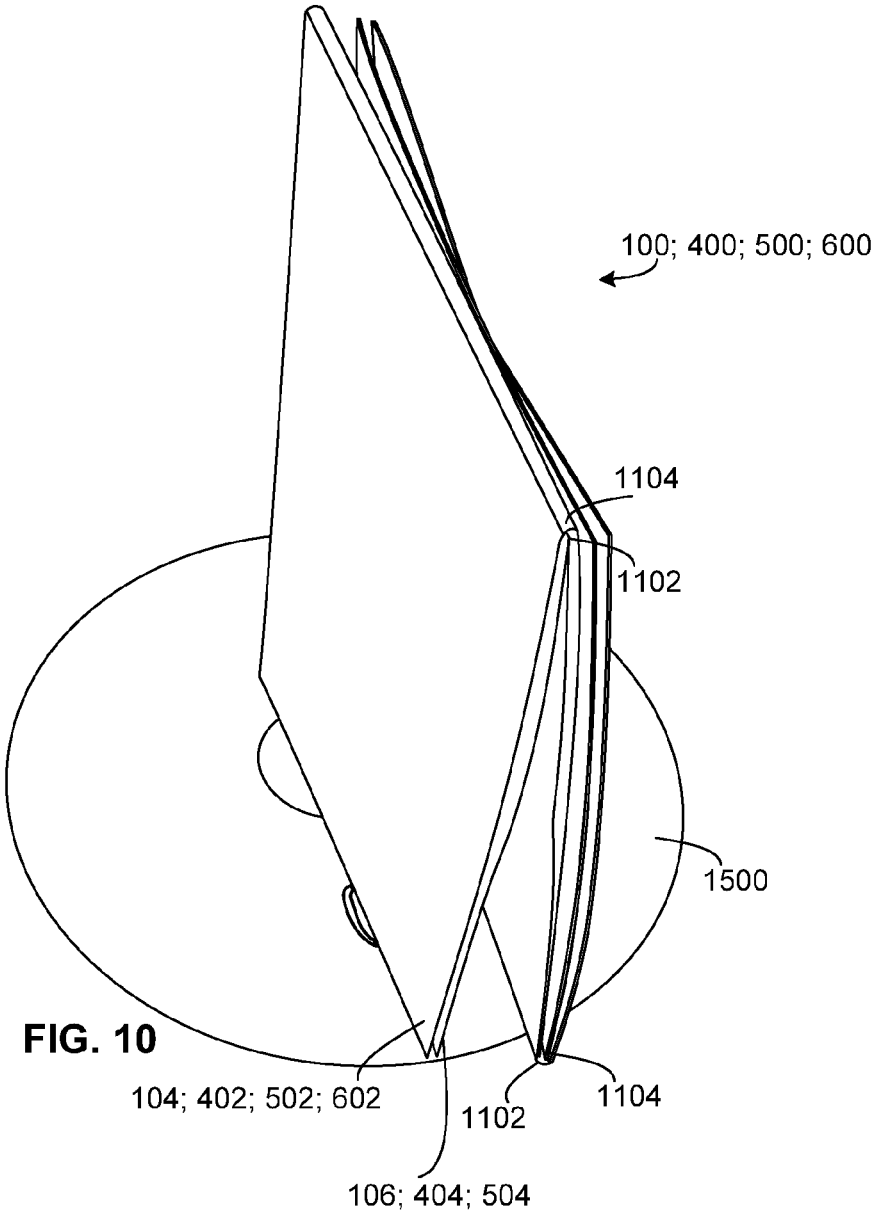
Figure 11:
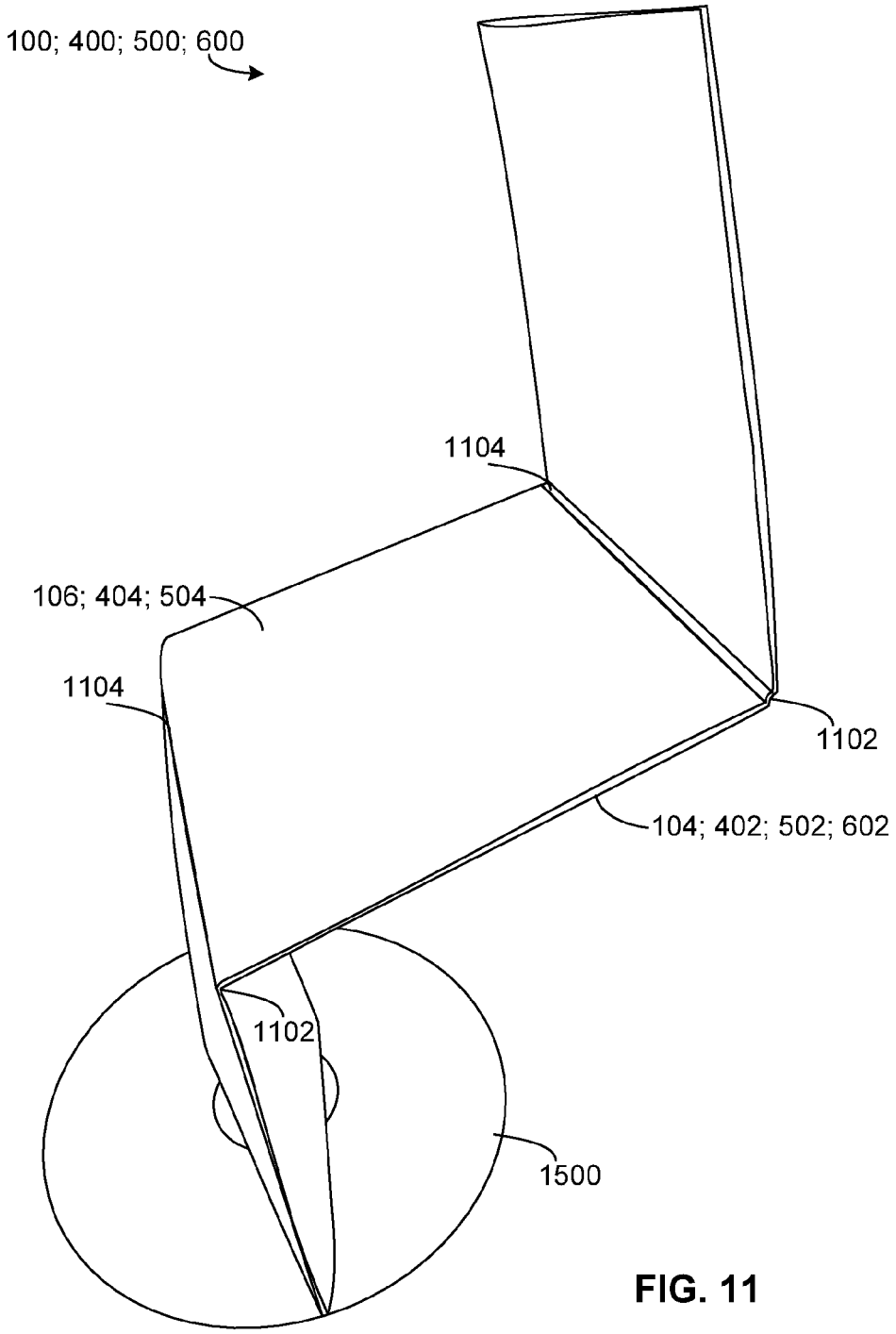
Figure 12:
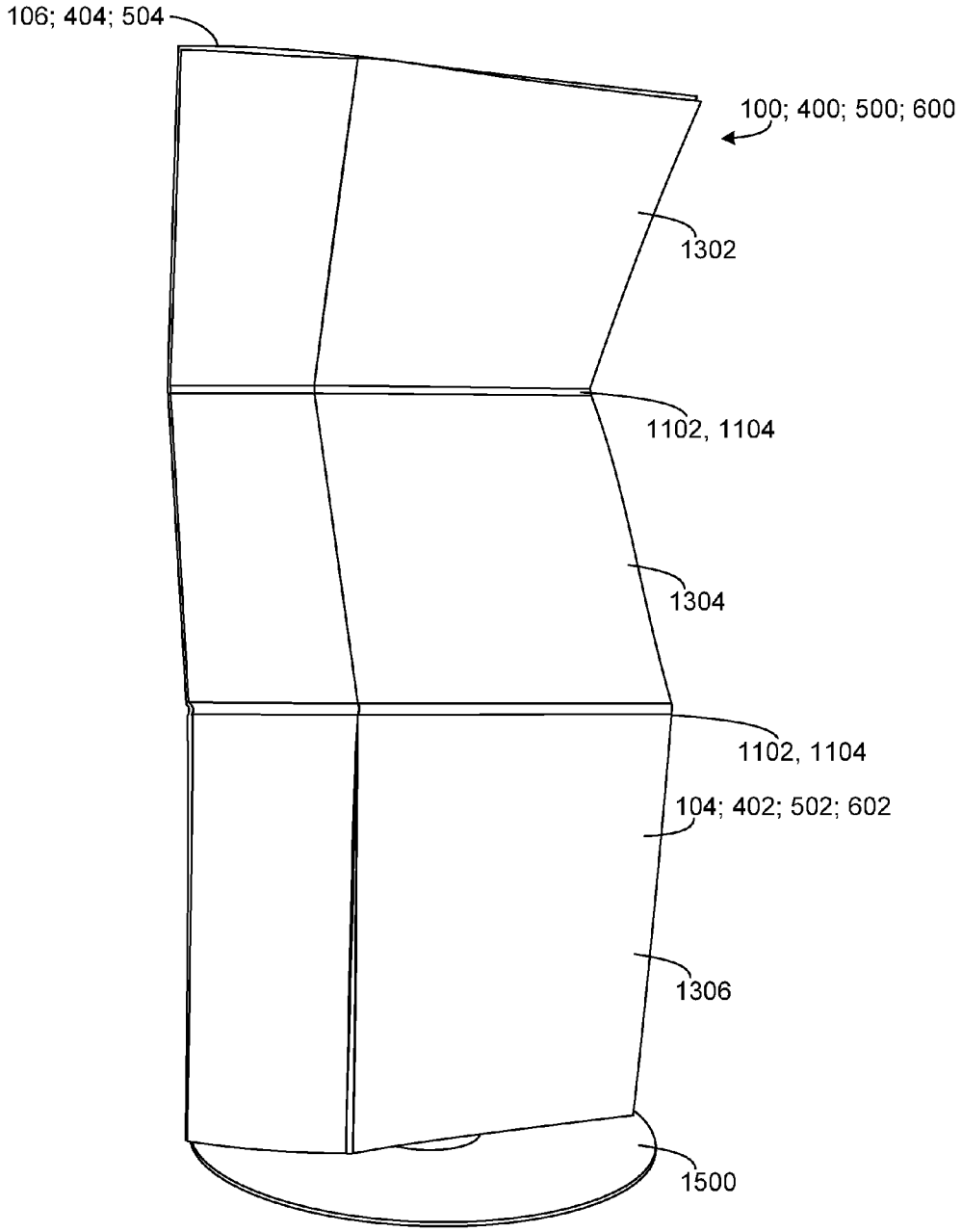

The example self-erectable display 101, 701 disclosed herein may be deployed from a storage state (FIG. 10) to an erected or deployed state (FIGS. 1 and 14) with little effort. For example, a user such as, for example, a shop clerk, can remove a folded display 101, 701 from an outer packaging or container 1002 (FIG. 10) and unfold the display 101, 701 along and/or over the lines of weakness 1102, 1104 (FIG. 10). The force imparted by the biasing member(s) 206 on the internal supports and/or flaps 108, 116, 122, 130, 406, 414, 419, 424, 508, 516, 520, 606, 614, 624, automatically forces the outer shroud panels 106, 112, 410, 421, 512, 525, 610, 622 to expand away from one another as disclosed above. In other words, as the display 101, 701 is unfolded, the display 101, 701 simply pops open by itself. The deployment of the display 101, 701 is then complete and the display 101, 701 is ready for placement in a desired location and/or coupling to an optional base 1500 (FIGS. 10-14) should additional stability be desired (as described below).

Figure 13:
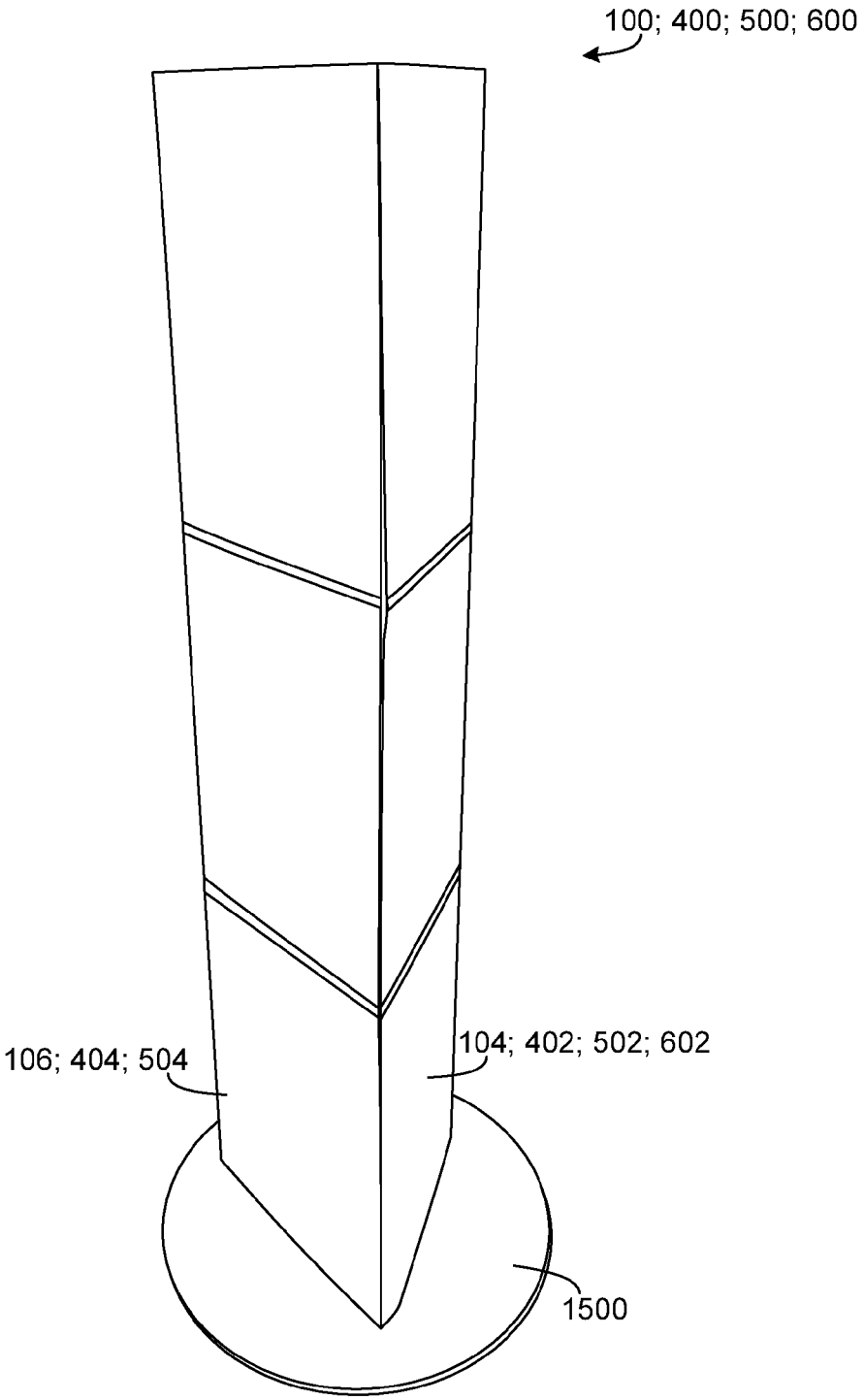
Figure 14:
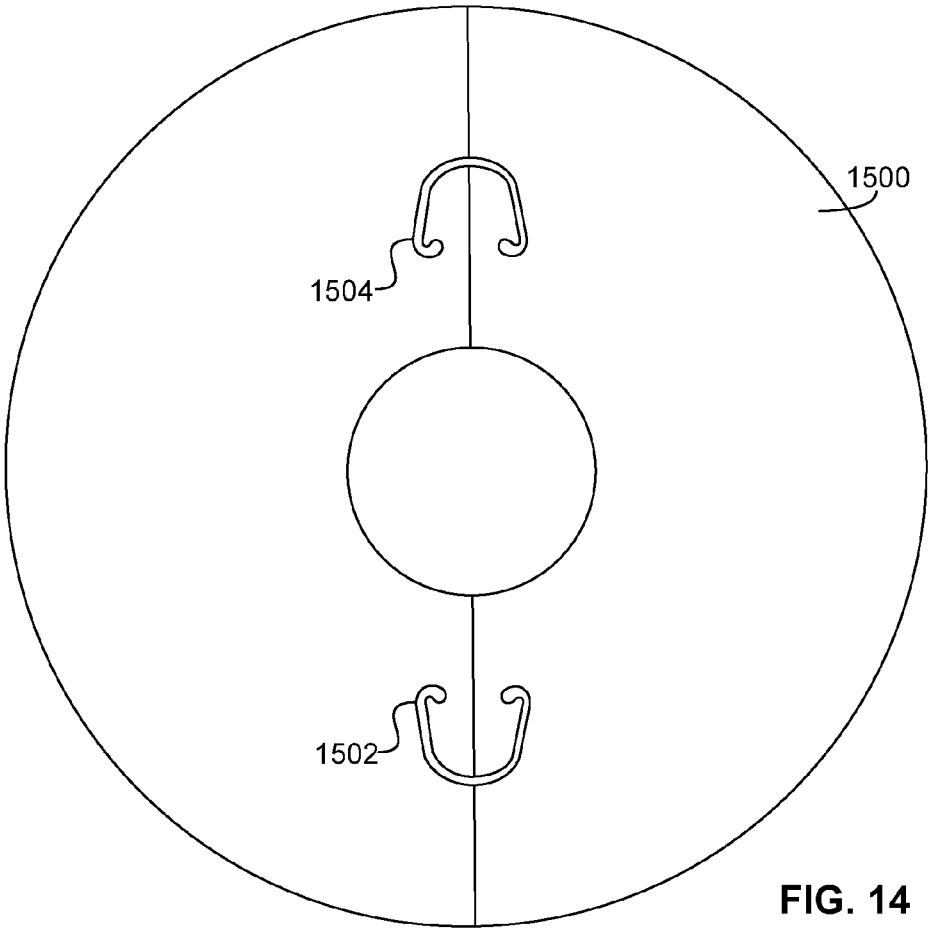
FIG. 14 illustrates an example base that can be used to implement the example self-erectable displays in accordance with the teachings of this disclosure.
Figure 15:
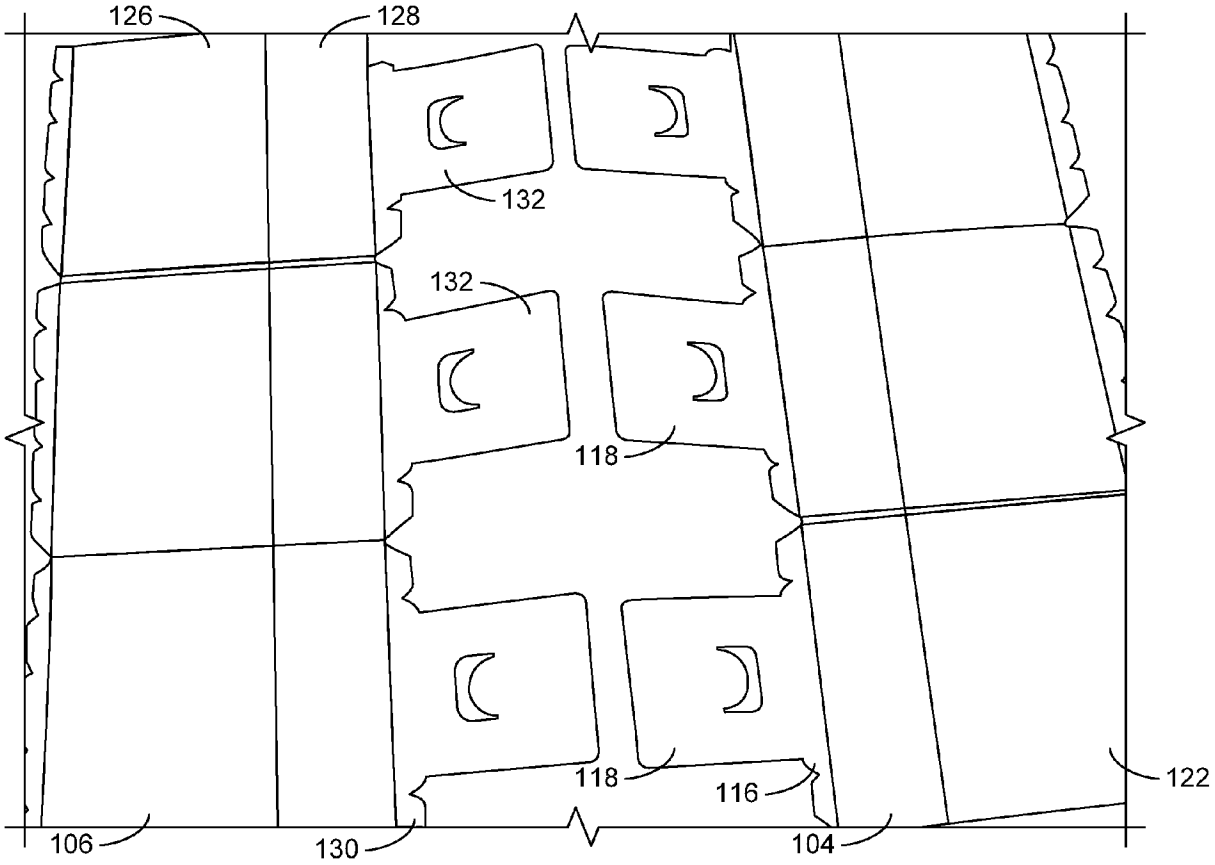
FIGS. 15-30 illustrate an example self-erectable display in accordance with the teachings of this disclosure progressing through an assembly process.
Figure 16:
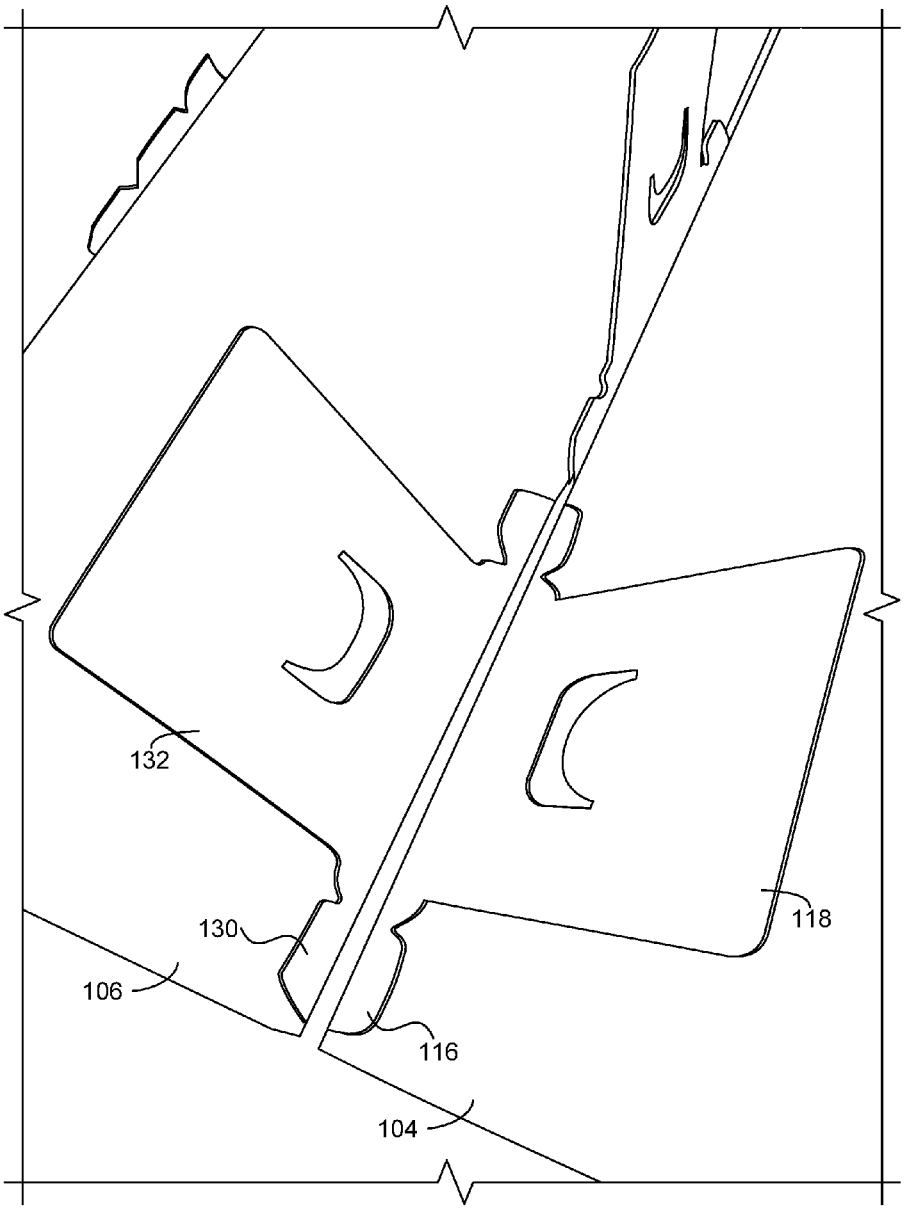
Figure 17:
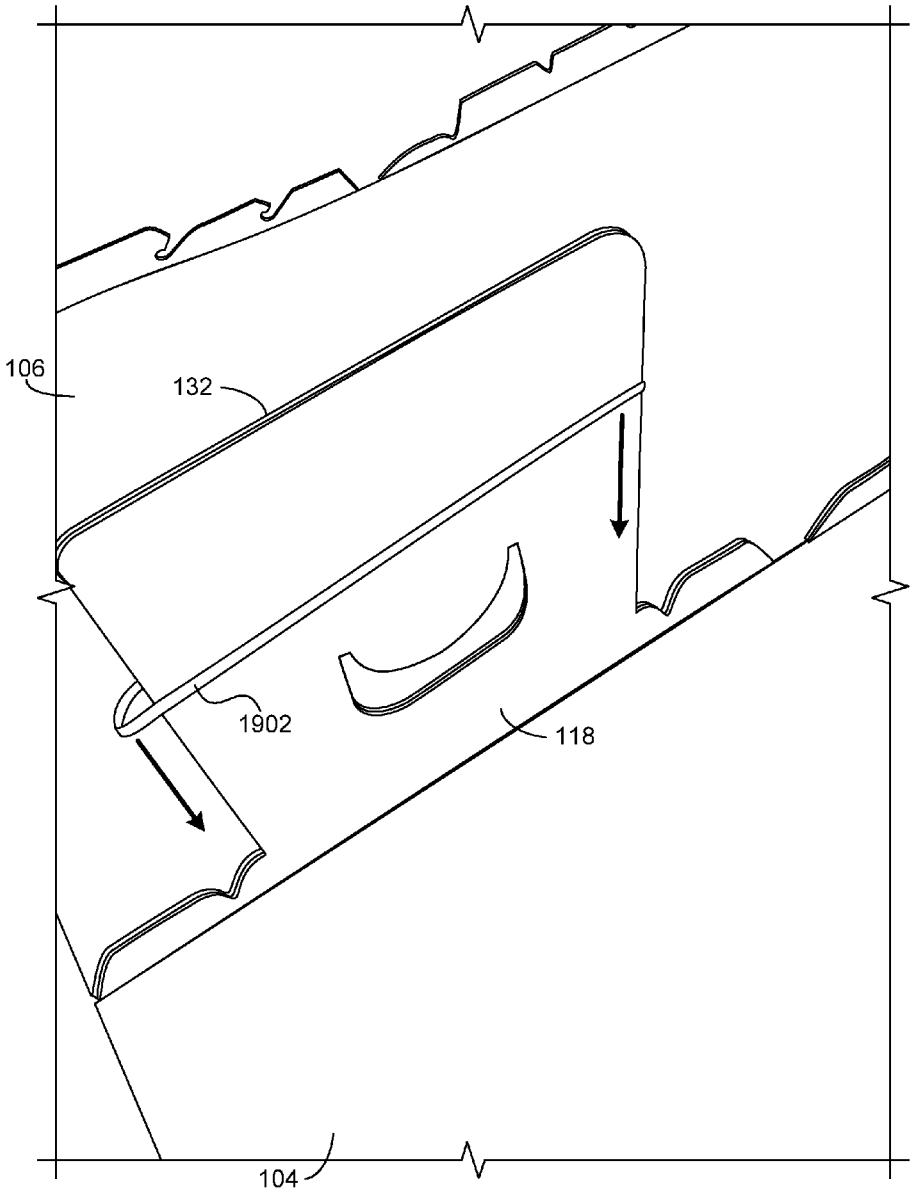
Figure 18:
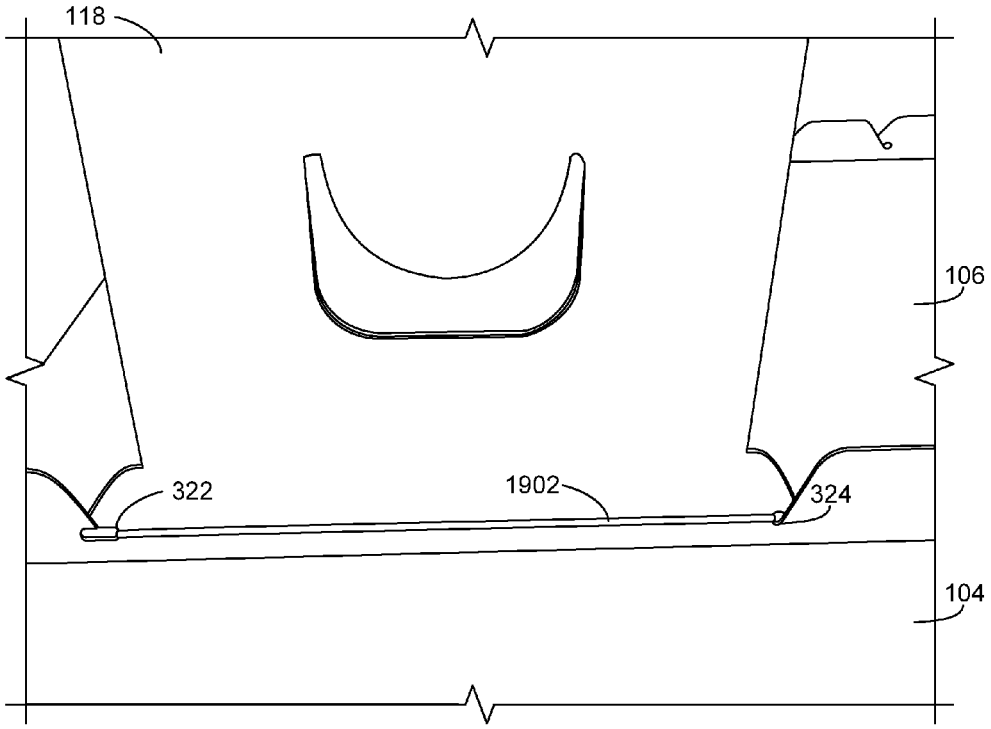
Figure 19:
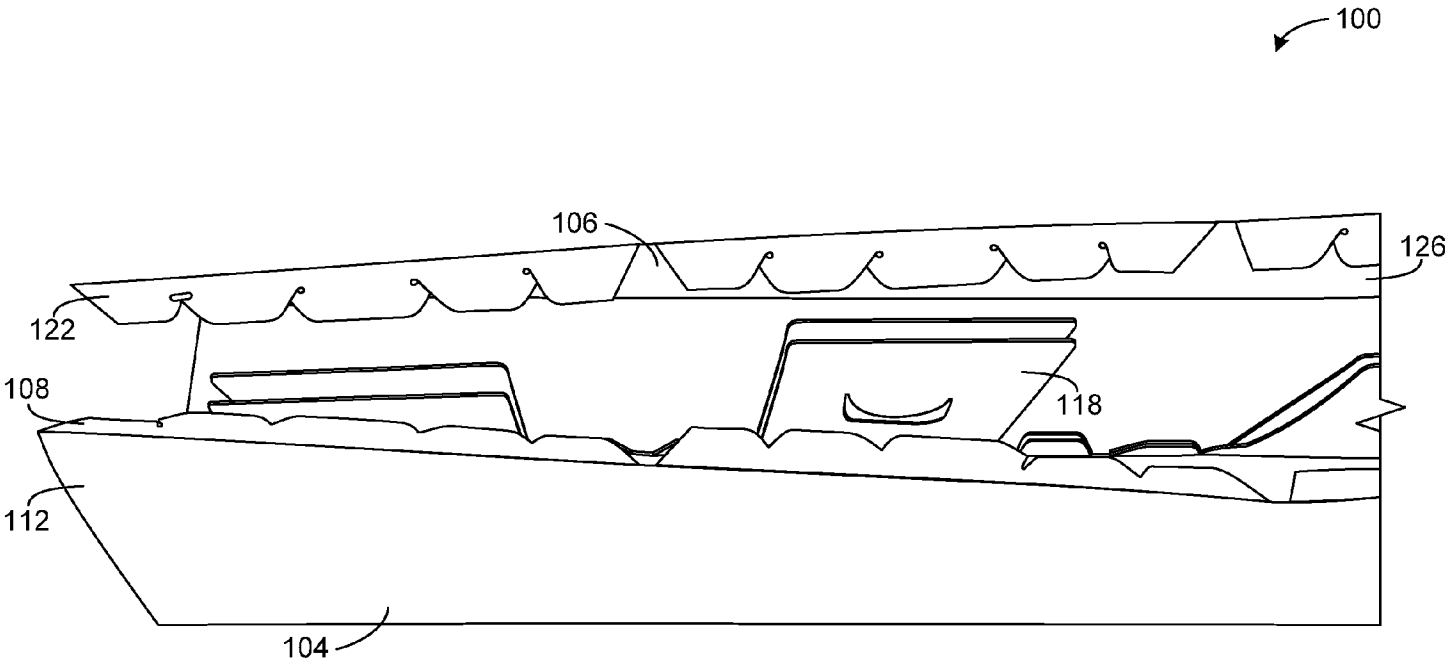
Figure 20:
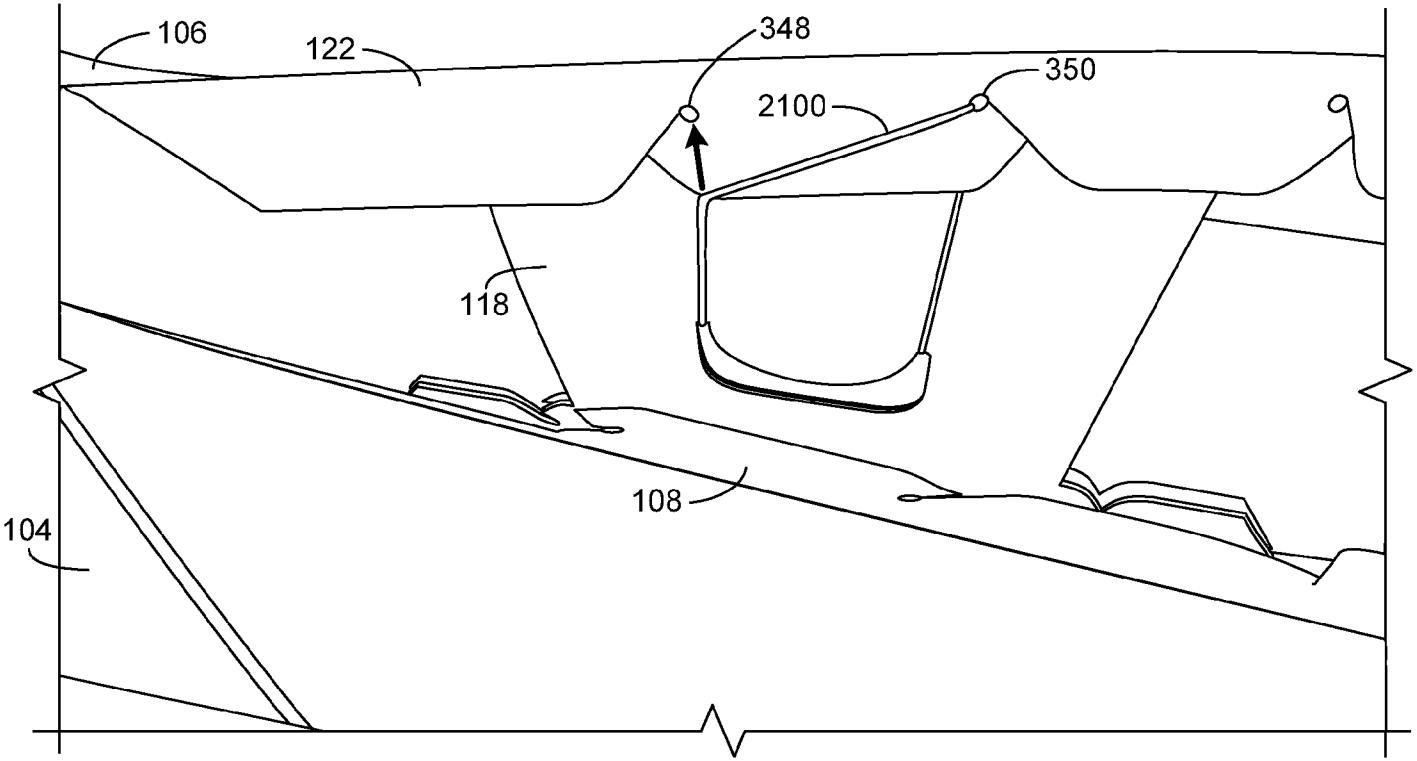
Figure 21:
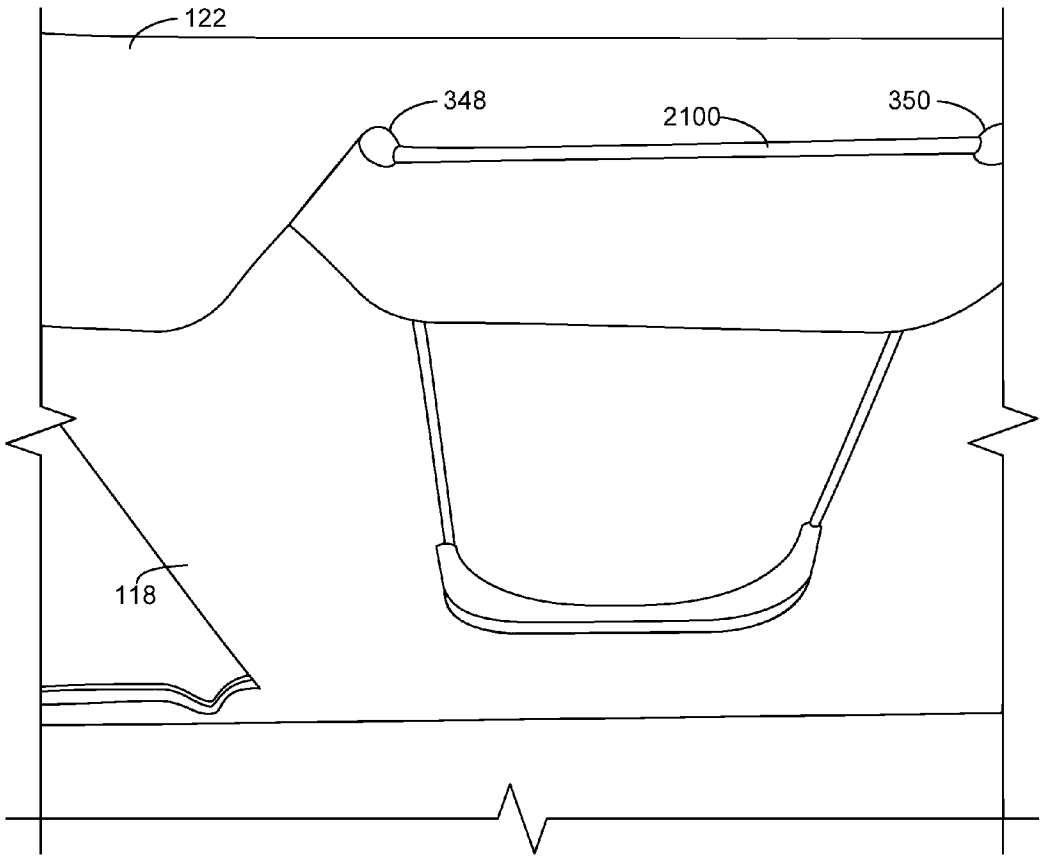
Figure 22:
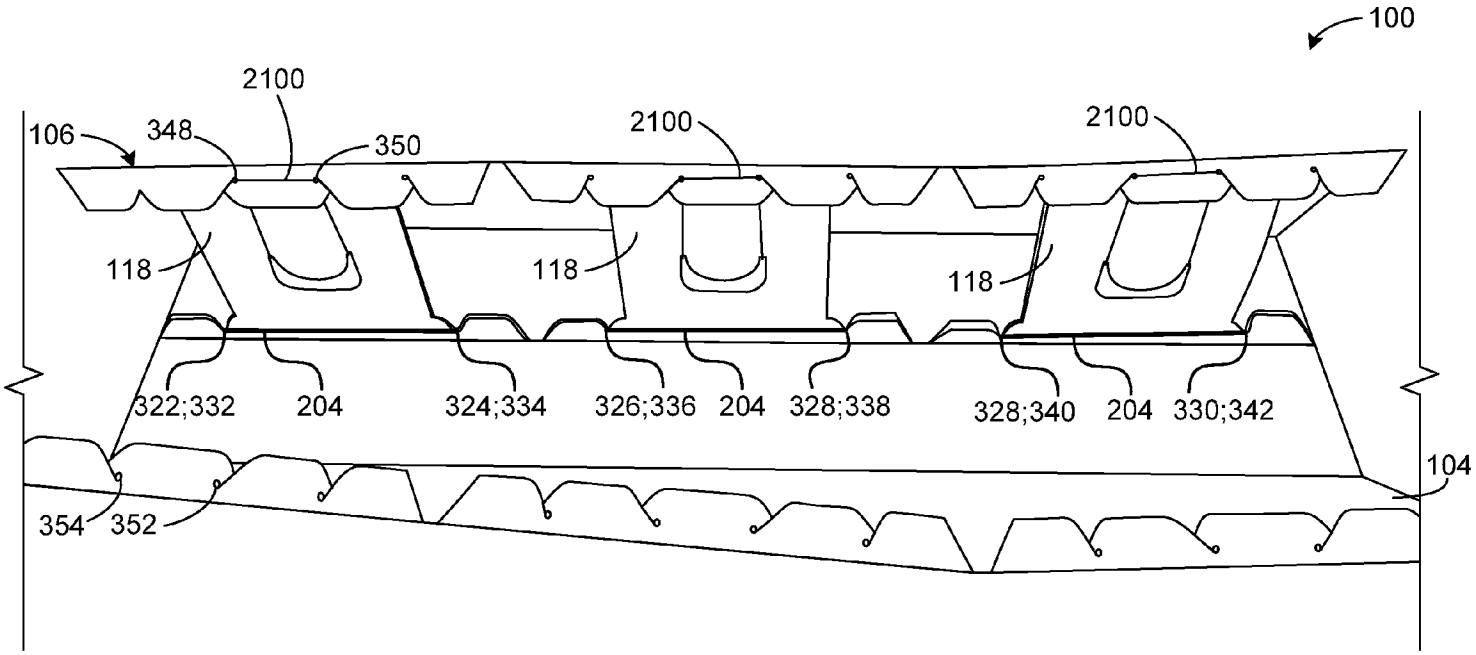
Figure 23:
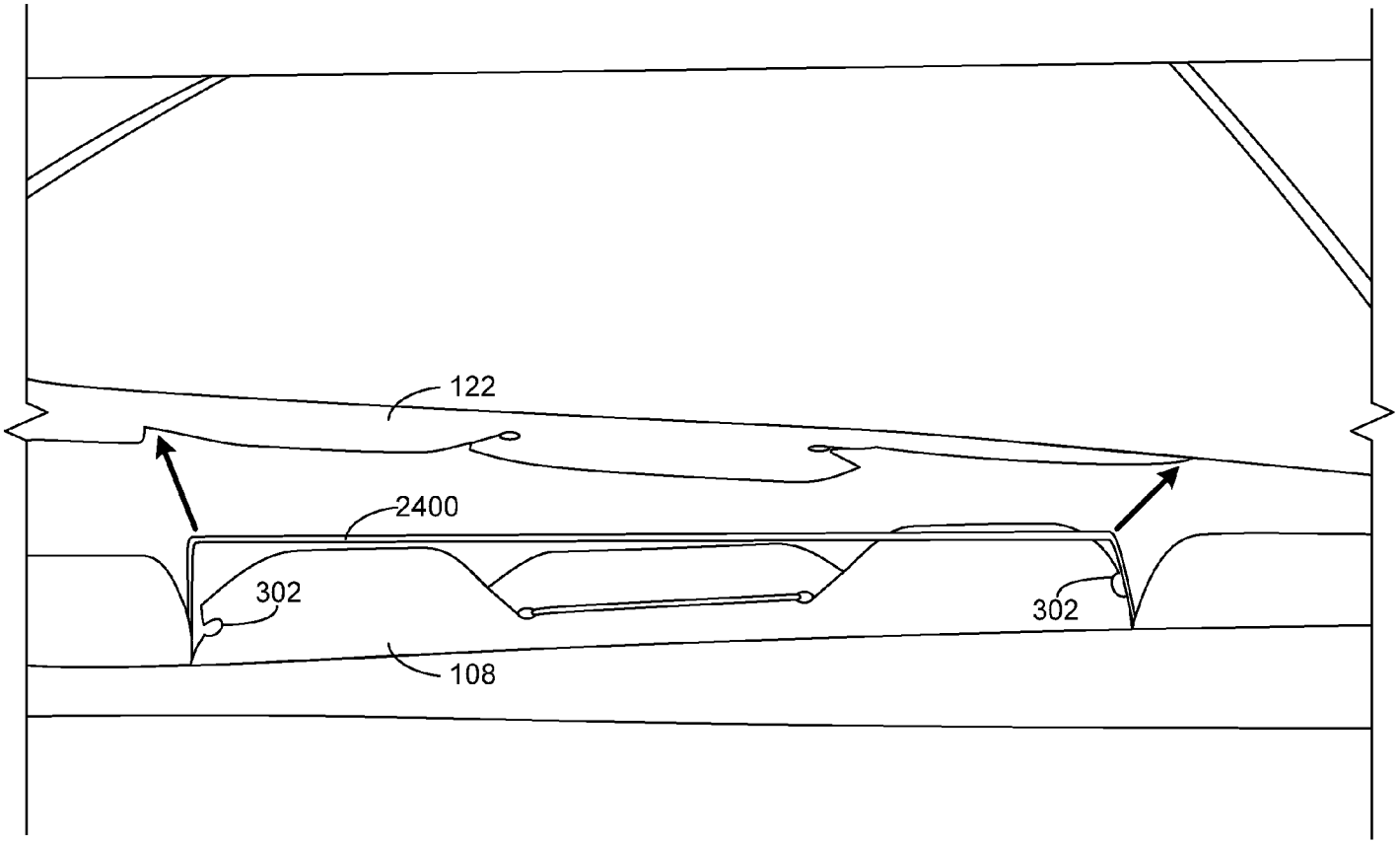
Figure 24:
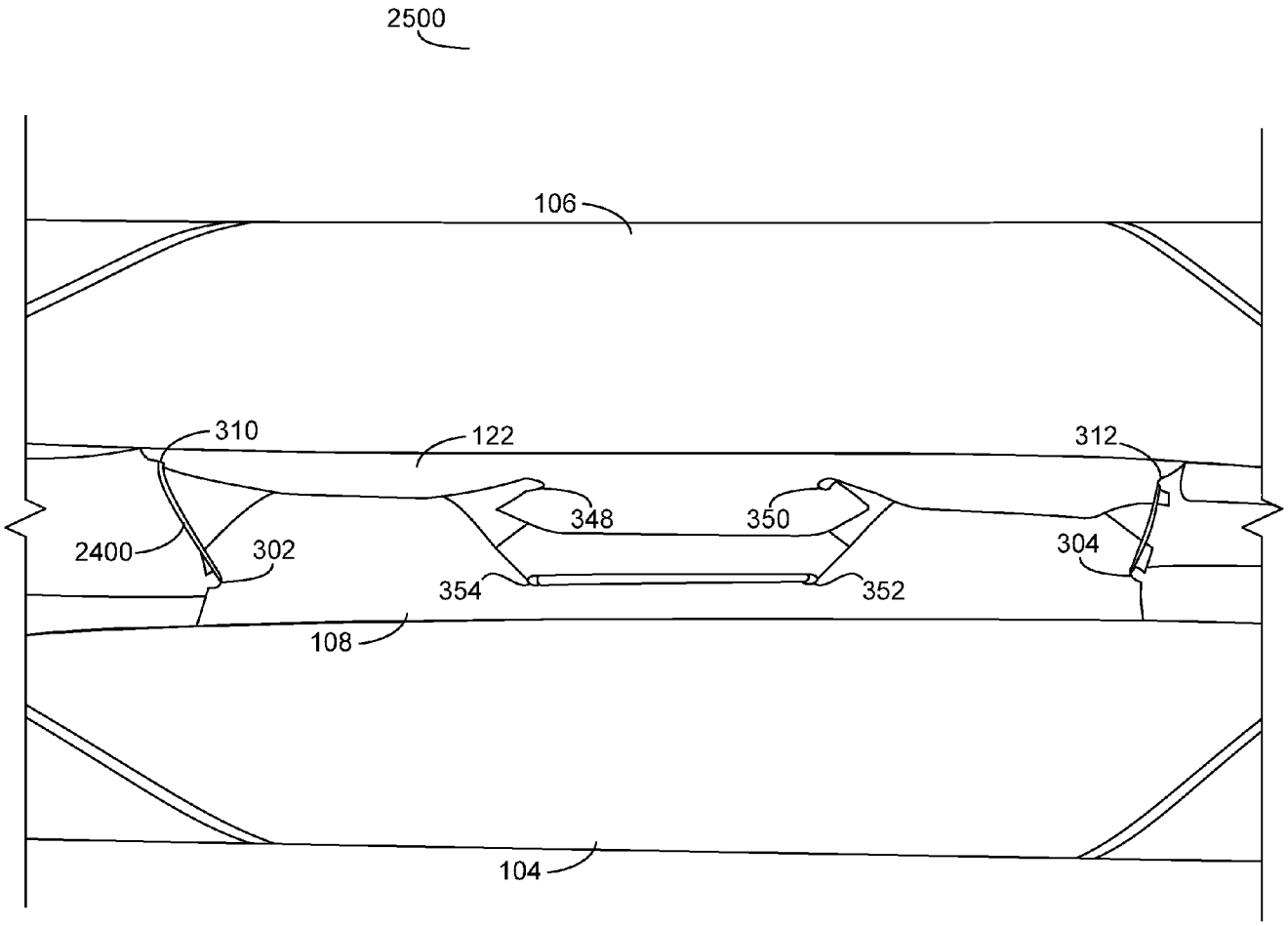
Figure 25:
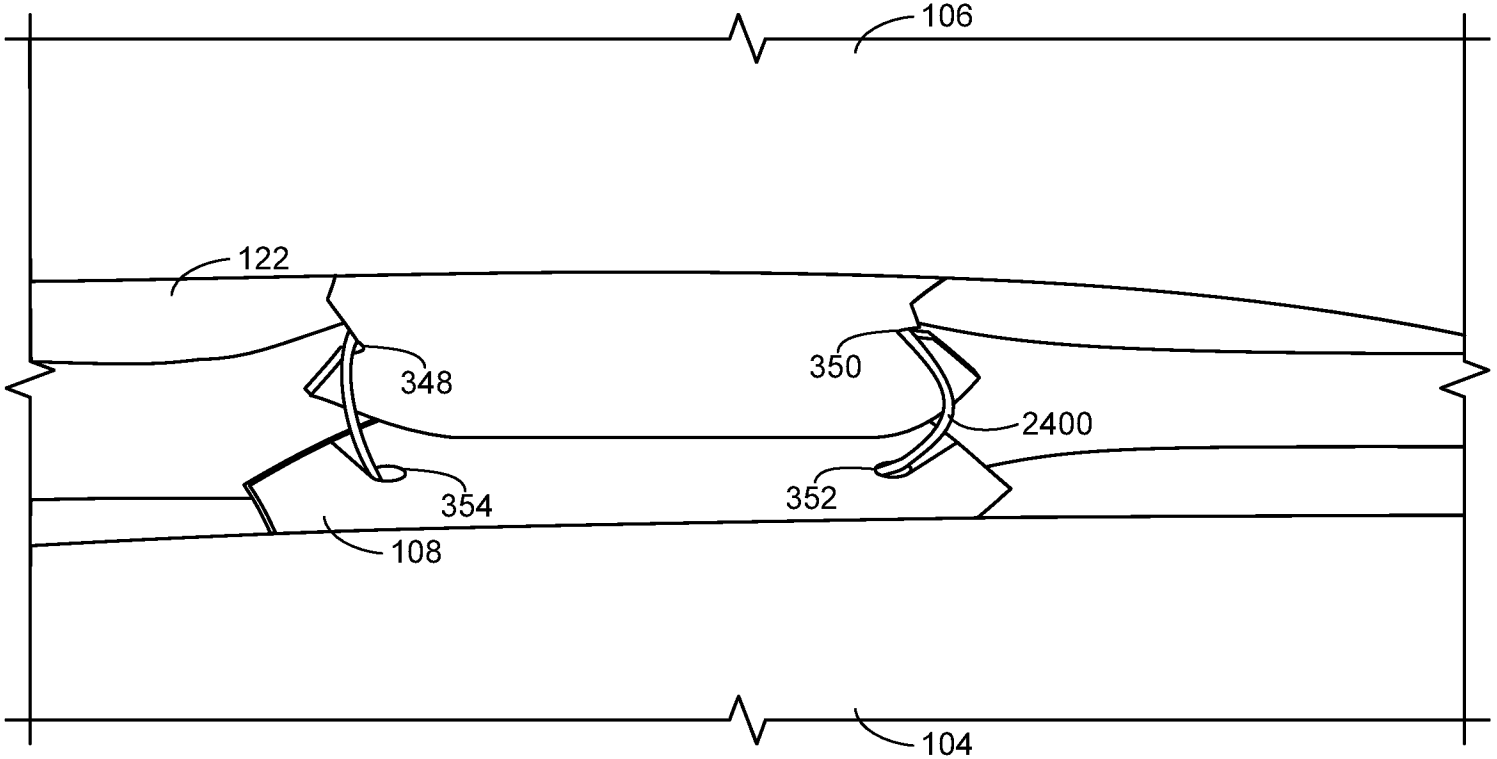
Figure 26:
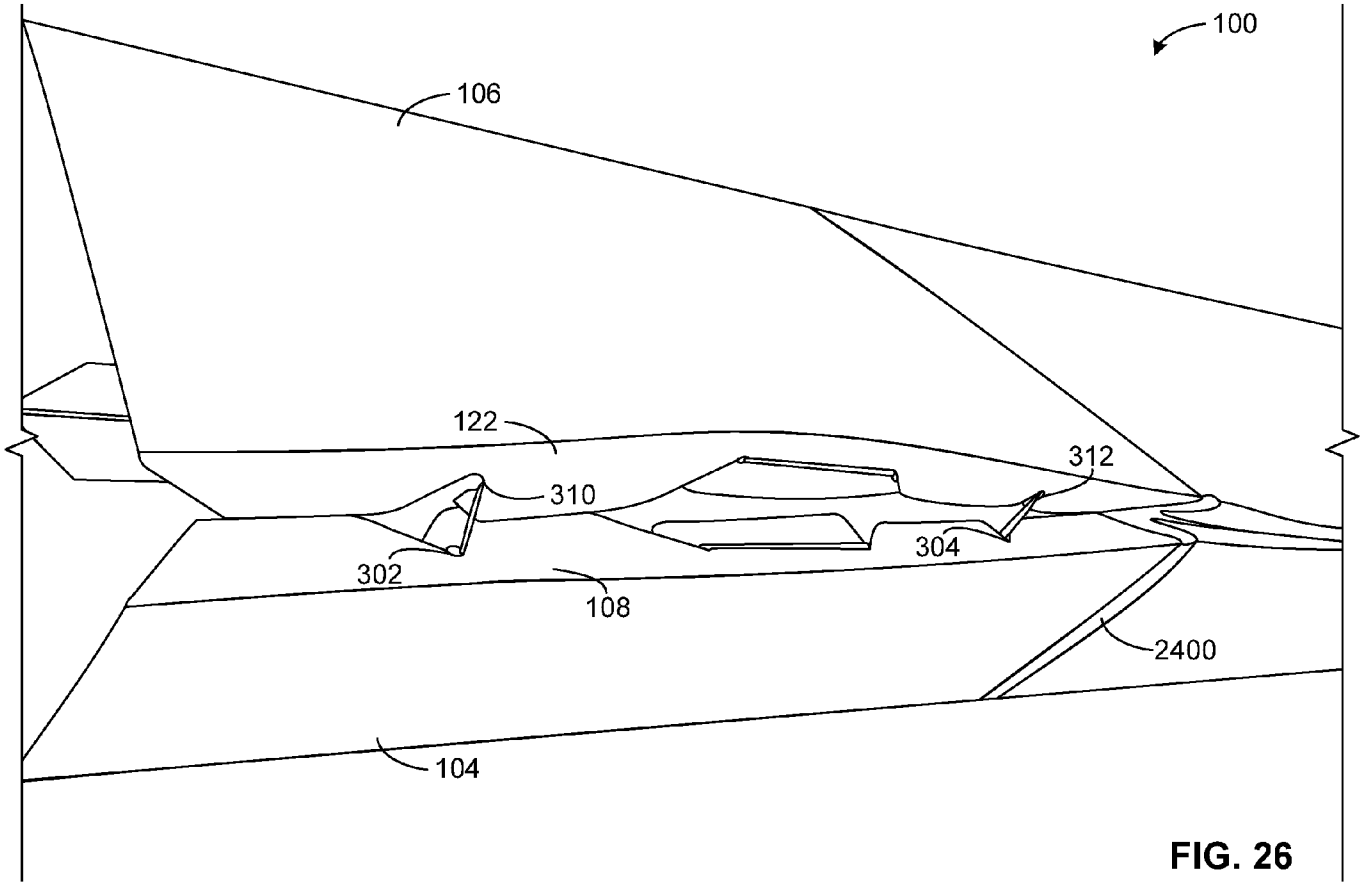

FIG. 1 illustrates an example self-erectable display including a tubular-shaped shroud having a triangular cross-section coupled to a base. In other examples, the example self-erectable display may not include the base such that the shroud 100 is used as an upright display and supported on its own. However, in those examples including a base, such as shown in FIG. 13, the base 1500 is coupled to the display 101, 701 using a biasing element coupled between apertures 1502, 1504 of the base 1500 and apertures 428, 430, 440, 442, 452, 454, 464 and/or 464, etc. of the respective shrouds 100, 400, 600, 800, as described in more detail below.

Figure 27:
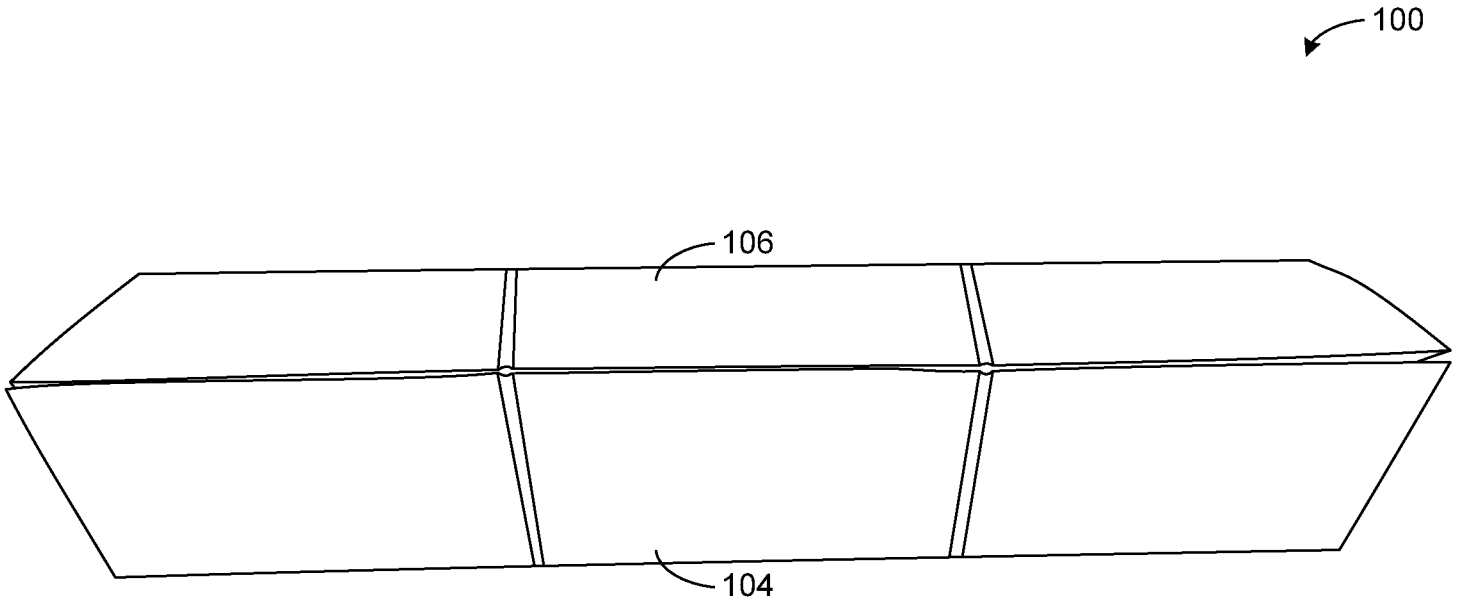

FIGS. 15-30 illustrate the example shroud 100 during an assembly process. For example, FIGS. 15-18 illustrate coupling the second and fourth flaps 116, 130 using a biasing element 1902 received within the apertures 322, 324. FIGS. 19-22 illustrate the example stops 118, 132 being coupled to the third flap 122 via a biasing element 2100 received in apertures 348, 349, 350, 351. FIGS. 23-26 illustrate the first and third flaps 108, 122 being coupled via a biasing element 2400 received in the apertures 302, 304, 310, 312. FIG. 27 illustrates the example shroud 100 formed as a complete tube (i.e., similar to the erected and/or deployed position).

Figure 28:
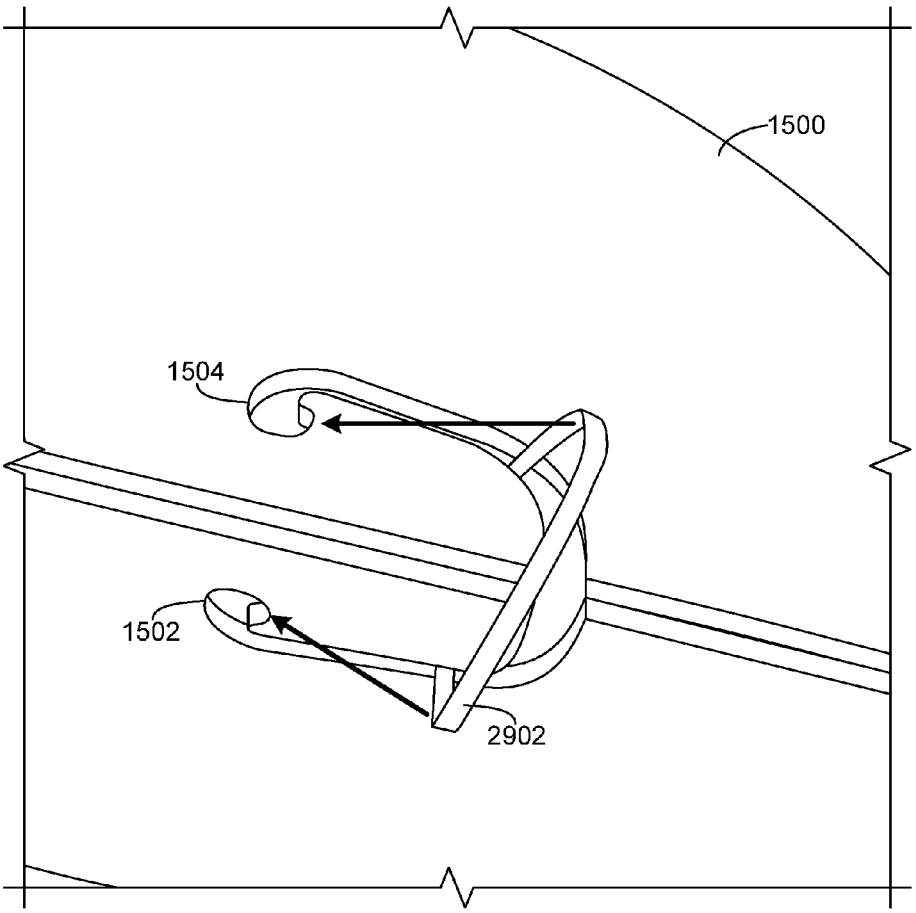
Figure 29:
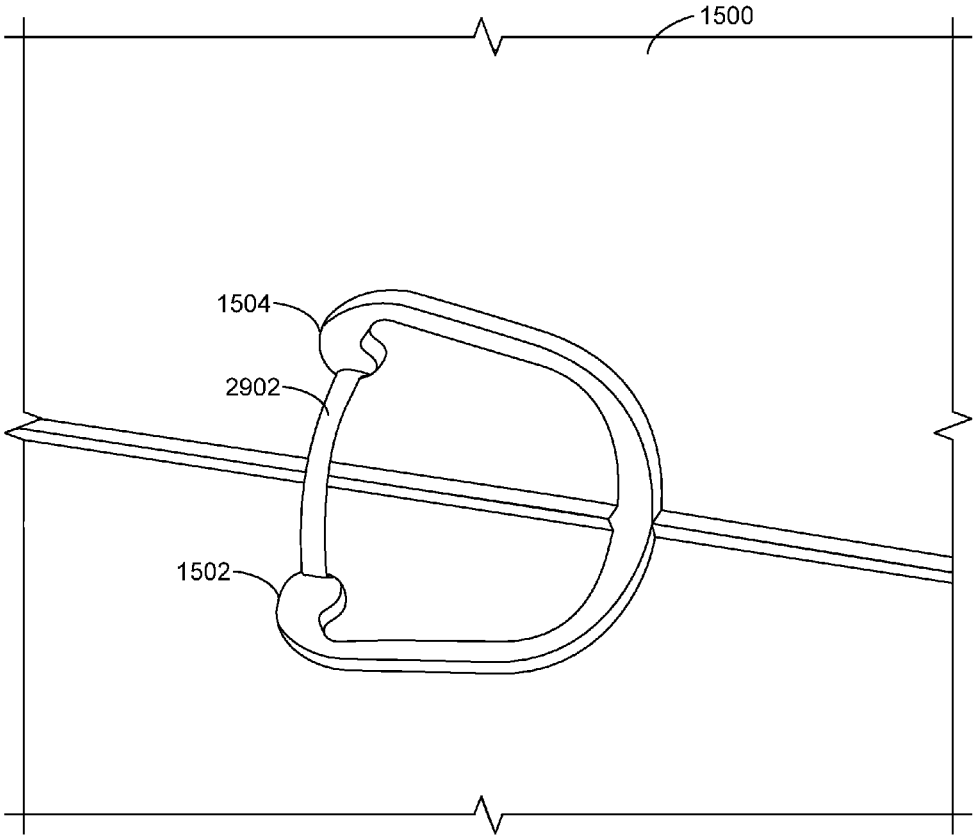
Figure 30:
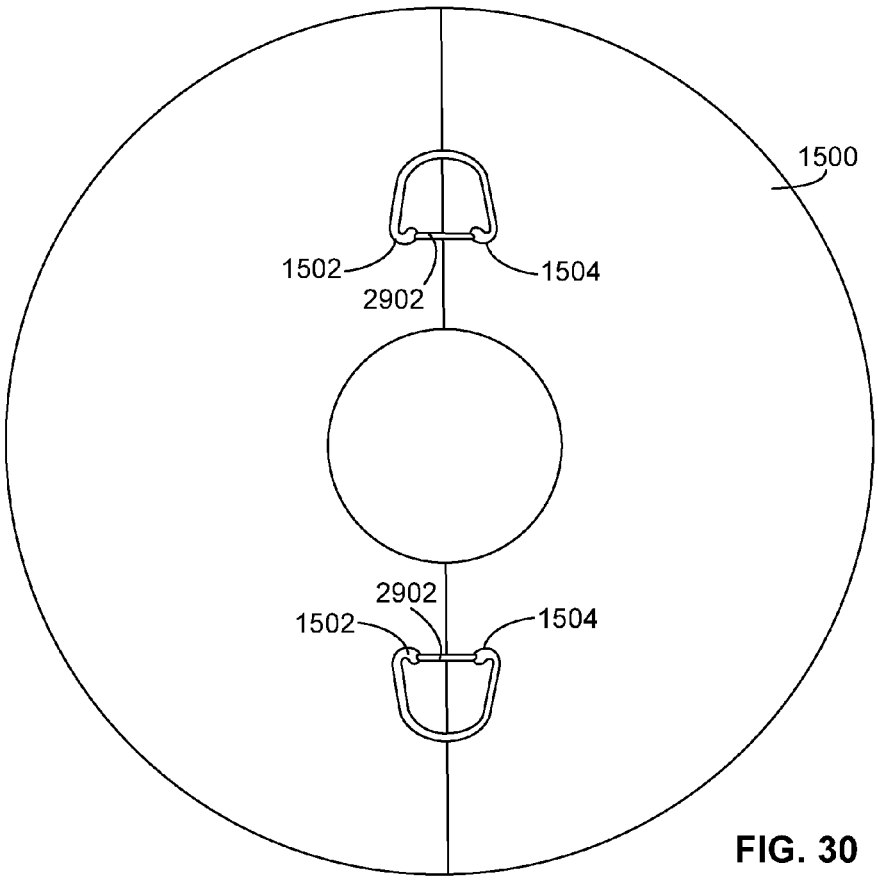

FIGS. 28 and 29 illustrate positioning a biasing element 2902 in apertures 1502, 1504 defined by the base 1500, which are used to couple the base to the shroud 100. In some examples, to couple the base 1500 to the shroud 100, 400, 500, 600, 800, the biasing element 2902 is coupled between the apertures 1502, 1504 and the apertures 302, 304, 310 and/or 312, etc. of the respective shrouds 100, 400, 500, 600, 800. FIG. 30 illustrates the example base 1500 with the biasing elements 2902 in position.

Figure 31:
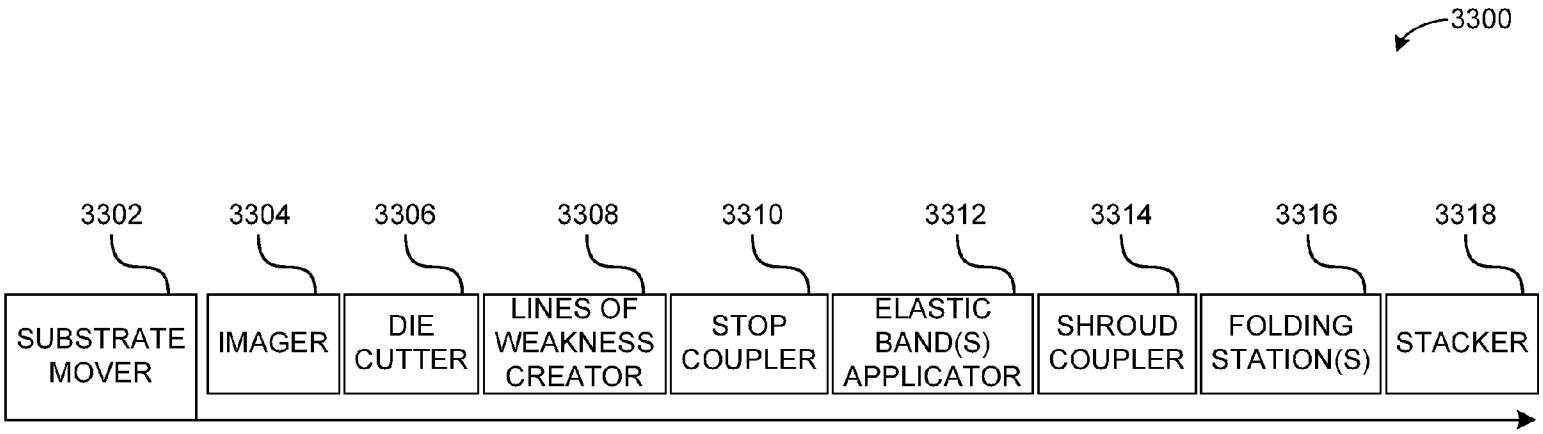
FIG. 31 illustrates an example apparatus that can be used to produce the example self-erectable displays disclosed herein.

FIG. 31 represents an example apparatus 3300 that can be used to produce the example self-erectable displays 101, 701 disclosed herein. In some examples, the apparatus 3300 performs an in-line process that includes processes to produce an example shroud 100, 400, 500, 600, 800 in accordance with the teachings of this disclosure and processes to produce an example self-erectable display 101, 701 in accordance with the teachings of this disclosure. While the processes disclosed below are described in connection with automatic processes, any and/or all of the processes disclosed may instead be implemented manually.

In this example, the example apparatus 3300 includes elements to produce the example shroud 100, 400, 500, 600, 800 and/or the example self-erectable display 101, 701 including, for example, a substrate mover 3302, an imager 3304, a die cutter 3306, a lines of weakness creator 3308, a stop coupler 3310, an elastic band applicator 3312, a shroud coupler 3314, a folding station 3316 and a stacker 3318.

To produce an example shroud 100, 400, 500, 600, 800 in accordance with the teachings of this disclosure, in some examples, the substrate mover 3302 feeds one or more pieces of substrate and/or a web of substrate into the apparatus 3300.

In some examples, the imager 3304 images a first and/or a second side of the shroud blank and/or a substrate(s) such as, for example, the example shrouds and substrates 100, 400, 500, 600, 800. The images may include brand-related images and/or text, advertising-related images and/or text, point-of-purchase-related images and/or text, instructional images and/or text, and/or any other desired indicia.

The die cutter 3306 forms one or more apertures and/or notches within the shroud and/or the substrate(s) such as, for example, the example notches 302, 303, 304, 305, 306, 307, 308, 322, 324, 326, 327, 328, 330, 332, 334, 336, 338, 340, 342, 310, 312, 314, 316, 318, 320, 428, 430, 432, 434, 436, 438, 440, 442, 444, 446, 448, 450, 464, 466, 468, 470, 472, 474, etc. In some examples, the die cutter forms substrates as illustrated in FIGS. 3A, 3B and 4-6 and, more generally, substrates 100, 400, 500, 600, 800 as disclosed herein.

The lines of weakness creator 3308 forms one or more lines of weakness 150, 152, 154, 156, 158, 160 on first and/or second sides of the shroud blank and/or the elongate substrate(s) 100, 400, 500, 600, 800, 104, 106, 402, 404, 502, 504, 602 using a die(s), a cutting tool(s), a scoring tool(s), a slotting tool(s), etc.

The stop coupler 3310 couples a stop(s) 506, 604 on the shroud blank and/or to the elongate substrate(s) 500, 600 (e.g., FIGS. 5-7).

The elastic band applicator 3312 couples one or more elastic band(s) adjacent one or more flap apertures 302, 303, 304, 305, 306, 307, 308, 322, 324, 326, 327, 328, 330, 332, 334, 336, 338, 340, 342, 310, 312, 314, 316, 318, 320, 428, 430, 432, 434, 436, 438, 440, 442, 444, 446, 448, 450, 464, 466, 468, 470, 472, 474, etc. defined by the shroud 100, 400, 500, 600, 800. In some examples, the elastic band applicator 3312 couples one or more elastic bands 206 between a stop 118, 132, 416, 506, 806 and an opposing flap(s) 108, 122, 406, 419, 508, 520 606, 624, 802. In some examples, the elastic band applicator 3312 couples one or more elastic bands 206 between side edges 108, 122, 406, 419, 508, 520, 606, 624, 802 and/or a vertex 208 and an opposing side 108, 122, 406, 419, 508, 520, 606, 624, 802 of the self-erectable displays 101, 701. In some examples, the elastic bands include barbs to facilitate coupling the elastic bands to the flap apertures 302, 303, 304, 305, 306, 307, 308, 322, 324, 326, 327, 328, 330, 332, 334, 336, 338, 340, 342, 310, 312, 314, 316, 318, 320, 428, 430, 432, 434, 436, 438, 440, 442, 444, 446, 448, 450, 464, 466, 468, 470, 472, 474, etc. and retention therein.

In some examples, the shroud coupler 3314 forms a tubular-shaped shroud 100, 400, 500, 600, 800 by folding the shroud 100, 400, 500, 600, 800 about its respective lines of weakness 150, 152, 154, 156, 158, 160 and coupling respective pairs of inwardly facing flaps 108, 116, 122, 130, 406, 414, 419, 424, 508, 516, 520, 528, 606, 624, 802.

The folding station 3316 flattens and/or folds the self-erectable display 101, 701 about longitudinal axes of the shroud 100, 400, 500, 600, 800 and/or folds the self-erectable display 101, 701 about transverse axes 352, 354, 356, 358, 360, 362, 364, 366, 1102, 1104 of the shroud 100, 400, 500, 600, 800 for storage and/or shipping.

The stacker 3318 stacks the self-erectable displays for storage and/or shipping, etc. In some examples, the processes implemented by the stop coupler 3310, the elastic band applicator 3312, the shroud coupler 3314, the folding station 3316 and/or the stacker 3318 are performed manually. In examples in which the stop is integral to the shroud and/or the elongated substrate(s), the stop coupler 3310 may be excluded.

While the stations and/or portions including the example substrate mover 3302, the example imager 3304, the example die cutter 3306, the example lines of weakness creator 3308, the stop coupler 3310, the example elastic band applicator 3312, the example shroud coupler 3314, the example folding station 3316 and/or the example stacker 3318 of the apparatus 3300 are depicted in a particular order, the stations and/or portions including the example substrate mover 3302, the example imager 3304, the example die cutter 3306, the example lines of weakness creator 3308, the stop coupler 3310, the example elastic band applicator 3312, the example shroud coupler 3314, the example folding station 3316 and/or the example stacker 3318 of the apparatus may be implemented in any other way. For example, the order of the stations and/or portions including the example substrate mover 3302, the example imager 3304, the example die cutter 3306, the example lines of weakness creator 3308, the stop coupler 3310, the example elastic band applicator 3312, the example shroud coupler 3314, the example folding station 3316 and/or the example stacker 3318 of the apparatus 3300 may be changed, and/or some of the stations and/or portions including the example substrate mover 3302, the example imager 3304, the example die cutter 3306, the example lines of weakness creator 3308, the example stop coupler 3310, the example elastic band applicator 3312, the example shroud coupler 3314, the example folding station 3316 and/or the example stacker 3318 of the apparatus 3300 may be changed, eliminated, or combined. For example, while the apparatus 3300 is depicted as having a die cutter 3306 being separate from a lines of weakness creator 3308, in some examples, the die cutter 3306 and the lines of weakness creator 3308 may be combined.

Figure 32:
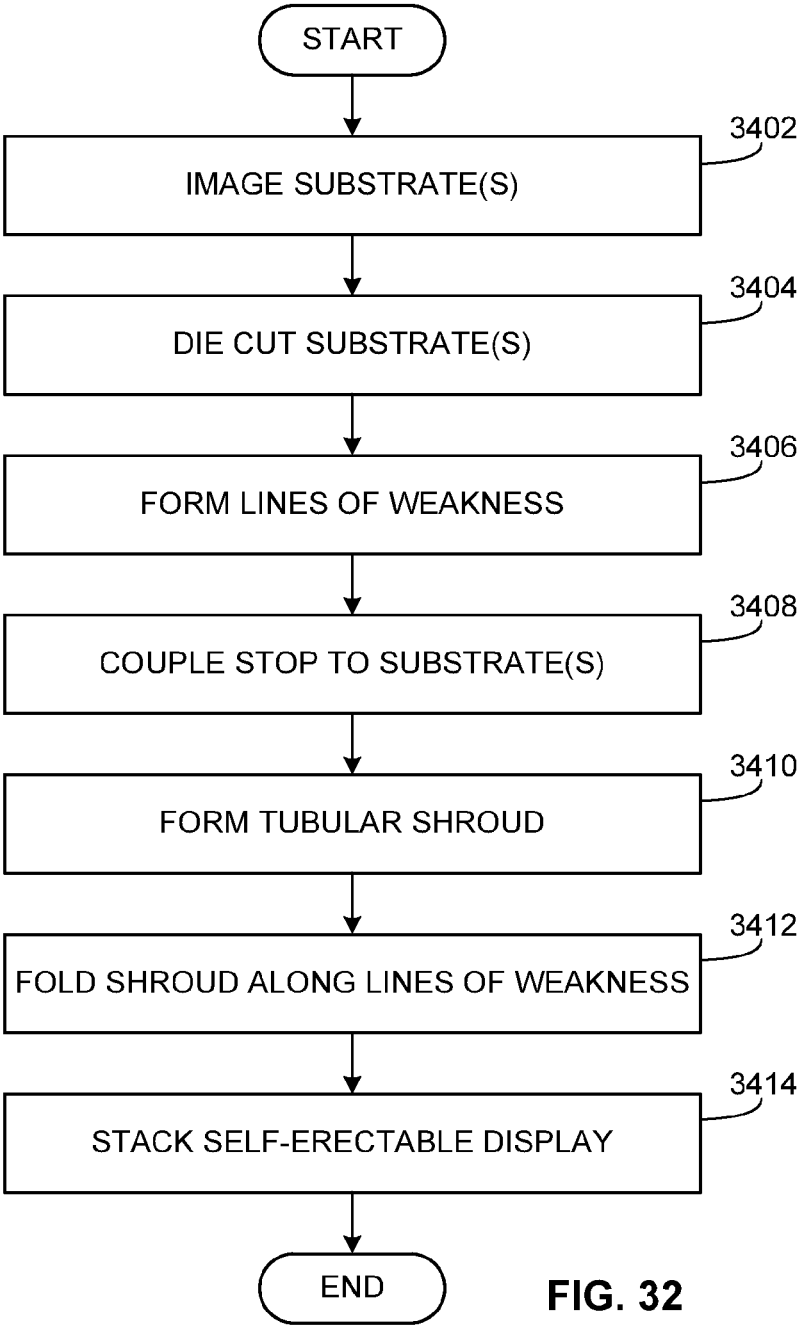
FIG. 32 illustrates a flowchart representative of machine readable instructions that may be executed to implement the apparatus of FIG. 31.
Figure 33:
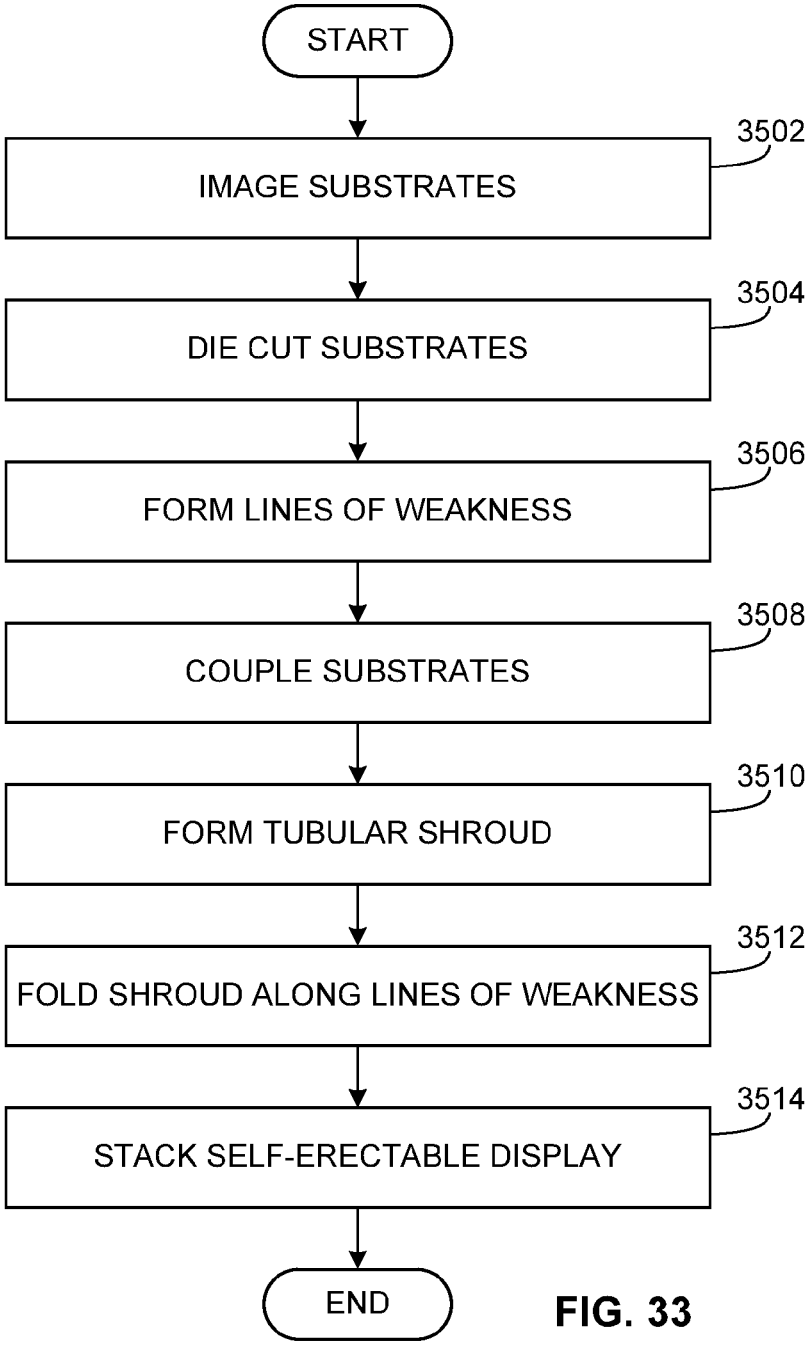
FIG. 33 illustrates another flowchart representative of machine readable instructions that may be executed to implement the apparatus of FIG. 31.

Flowcharts representative of example machine readable instructions for implementing the apparatus of FIG. 31 is shown in FIGS. 32 and 33. In these examples, the machine readable instructions comprise program(s) for execution by a processor such as the processor 3612 shown in the example processor platform 3600 discussed below in connection with FIG. 34. The programs may be embodied in software stored on a tangible computer readable storage medium such as a CD-ROM, a floppy disk, a hard drive, a digital versatile disk (DVD), a Blu-ray disk, or a memory associated with the processor 3612, but the entire programs and/or parts thereof could alternatively be executed by a device other than the processor 3612 and/or embodied in firmware or dedicated hardware. Further, although the example programs are described with reference to the flowcharts illustrated in FIGS. 32 and 33, many other methods of implementing the example apparatus of FIG. 31 may alternatively be used. For example, the order of execution of the blocks may be changed, and/or some of the blocks described may be changed, eliminated, or combined.

As mentioned above, the example processes of FIGS. 32 and 33 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals, carrier waves, and transmission media. As used herein, "tangible computer readable storage medium" and "tangible machine readable storage medium" are used interchangeably. Additionally or alternatively, the example processes of FIGS. 32 and 33 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals, carrier waves, and transmission media. As used herein, when the phrase "at least" is used as the transition term in a preamble of a claim, it is open-ended in the same manner as the term "comprising" is open ended.

FIG. 32 relates to processes of producing example self-erectable displays that include a stop that is separate from the tubular substrate and couplable thereto. An example of such a display is shown in a flattened state in FIGS. 5 and 6. The example process of FIG. 32 includes imaging a substrate (e.g., the shroud 500) (block 3402) using, for example, the imager 3304 that images a first and/or second side of the shroud 500, 600 and/or a first and/or a second side of an elongated substrate(s) 502, 504, 602 with, for example, brand-related images and/or text, advertising-related images and/or text, point-of-purchase-related images and/or text, instructional images and/or other text, indicia and/or images.

The substrate(s) is die cut (block 3404) using, for example, the die cutter 3306 that die cuts the shroud 500, 600 to form the apertures 647, 648, 650, 652, 654, 656, 658, 660, 662, 664, 666, 668, etc. and/or the flaps 606, 614, 624 and/or separates the elongate substrates 602 from one another. The die cutter 3306 may also be used to form notches, eyelets, apertures, 647, 648, 650, 652, 654, 656, 658, 660, 662, 664, 666, 668, etc. Lines of weakness are formed (block 3406) using, for example, the lines of weakness creator 3308 that forms one or more lines of weakness 150, 152, 154, 156, 158, 160 on first and/or second sides of the shroud blank 500, 600 and/or first and/or second sides of an elongate substrate(s) 502, 504, 602 using a die(s), a cutting tool(s), a scoring tool(s), a slotting tool(s), etc.

A stop is coupled to a substrate(s) (block 3408) using, for example, the stop coupler 3310 that couples the stop 506, 604 to an inward facing flap 508, 516, 520, 528, 606, 614 and/or 624. The tubular shroud is formed (block 3410) using, for example, the shroud coupler 3314 that folds the shroud 500, 600 about different lines of weakness 150, 152, 154, 156, 158, 160 and couples respective pairs of inwardly facing flaps 606, 614, 624 using, for example, adhesive, glue and/or a staple(s).

The self-erectable display is folded along lines of weakness (block 3412) using, for example, the folding station 3316 that flattens and/or folds the self-erectable display 701 about longitudinal axes of the shroud 100, 400, 500, 600, 800 and/or transverse axes 670 (FIG. 6) of the shroud 100, 400, 500, 600, 800 for storage and/or shipping. The folded self-erectable display is stacked (block 3414) using, for example, the stacker 3318 that stacks the self-erectable displays for storage and/or shipping, etc.

FIG. 33 relates to processes of producing example self-erectable display that are formed using a substrate(s) including an integral stop. An example of such a display is shown in a flattened state in FIG. 3A, 4, 8. The process of FIG. 33 includes imaging a substrate (e.g., the shroud 300) (block 3502) using, for example, the imager 3304 that images a first and/or second side of the shroud 100, 400, 800 and/or a first and/or a second side of an elongated substrate(s) 104, 106, 402, 404, 800 with, for example, brand-related images and/or text, advertising-related images and/or text, point-of-purchase-related images and/or text, instructional images and/or other text, indicia and/or images.

The substrate(s) is die cut (block 3504) using, for example, the die cutter 3306 that die cuts the shroud 100, 400 to form the apertures 302, 303, 304, 305, 306, 307, 308, 322, 324, 326, 327, 328, 330, 332, 334, 336, 338, 340, 342, 310, 312, 314, 316, 318, 320, 428, 430, 432, 434, 436, 438, 452, 454, 456, 458, 460, 462, 464, 466, 468, 470, 472, 474, 440, 442, 444, 446, 448, 450, 562, 564, 566, 568, 570, 572, 574, 576 and/or the flaps 108, 116, 130, 122, 406, 414, 419, 424, 606, 802 and/or separates the elongate substrates 104, 106, 402, 404 from one another. The die cutter 3306 may also be used to form notches, eyelets, apertures, 302, 303, 304, 305, 306, 307, 308, 322, 324, 326, 327, 328, 330, 332, 334, 336, 338, 340, 342, 310, 312, 314, 316, 318, 320, 428, 430, 432, 434, 436, 438, 452, 454, 456, 458, 460, 462, 464, 466, 468, 470, 472, 474, 440, 442, 444, 446, 448, 450, 562, 564, 566, 568, 570, 572, 574, 576, etc. Lines of weakness are formed (block 3506) using, for example, the lines of weakness creator 3308 that forms one or more lines of weakness 150, 152, 154, 156, 158, 160 on first and/or second sides of the shroud blank 100, 400, 800 and/or first and/or second sides of an elongate substrate(s) 104, 106, 402, 404 using a die(s), a cutting tool(s), a scoring tool(s), a slotting tool(s), etc.

The substrates are coupled (block 3508) using, for example, the shroud coupler 3314 that couples inward facing flaps 108, 116, 122, 130, 406, 414, 419, 424, 606, 802. The tubular shroud is formed (block 3510) using, for example, the shroud coupler 3314 that folds the shroud 100, 400 about different lines of weakness 150, 152, 154, 156, 158, 160 and couples respective pairs of inwardly facing flaps 108, 116, 122, 130, 406, 414, 419, 424, 606, 802 using, for example, adhesive, glue and/or a staple(s).

The self-erectable display is folded along lines of weakness (block 3512) using, for example, the folding station 3316 that flattens and/or folds the self-erectable display 101 about longitudinal axes of the shroud 100, 400 and/or transverse axes 352, 354, 356, 358, 360, 362, 364, 366 of the shroud 100, 400 for storage and/or shipping. The folded self-erectable display is stacked (block 3514) using, for example, the stacker 3318 that stacks the self-erectable displays for storage and/or shipping, etc.

Figure 34:
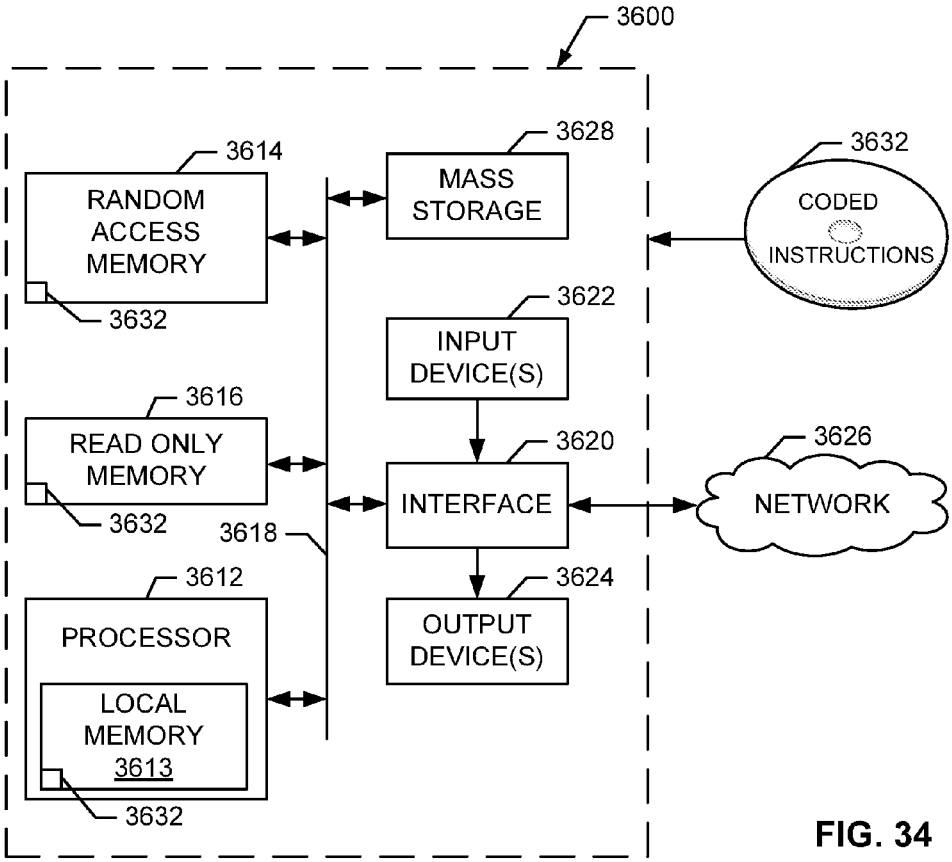
FIG. 34 illustrates a processor platform to execute the instructions of FIGS. 32 and 33 to implement the apparatus of FIG. 31.

FIG. 34 is a block diagram of an example processor platform 3600 capable of executing the instructions of FIGS. 32-33 to implement the apparatus 3300 of FIG. 31. The processor platform 3600 can be, for example, a server, a personal computer, a mobile device (e.g., a tablet such as an iPad™), an Internet appliance, a DVD player, a CD player, a digital video recorder, a Blu-ray player, or any other type of computing device.

The processor platform 3600 of the illustrated example includes a processor 3612. The processor 3612 of the illustrated example is hardware. For example, the processor 3612 can be implemented by one or more integrated circuits, logic circuits, microprocessors or controllers from any desired family or manufacturer.

The processor 3612 of the illustrated example includes a local memory 3613 (e.g., a cache). The processor 3612 of the illustrated example is in communication with a main memory including a volatile memory 3614 and a non-volatile memory 3616 via a bus 3618. The volatile memory 3614 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 3616 may be implemented by flash memory and/or any other desired type of memory device. Access to the main memory 3614, 3616 is controlled by a memory controller.

The processor platform 3600 of the illustrated example also includes an interface circuit 3620. The interface circuit 3620 may be implemented by any type of interface standard, such as an Ethernet interface, a universal serial bus (USB), and/or a PCI express interface.

In the illustrated example, one or more input devices 3622 are connected to the interface circuit 3620. The input device(s) 3622 permit(s) a user to enter data and commands into the processor 3612. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 3624 are also connected to the interface circuit 920 of the illustrated example. The output devices 3624 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 3620 of the illustrated example, thus, typically includes a graphics driver card, a graphics driver chip or a graphics driver processor.

The interface circuit 3620 of the illustrated example also includes a communication device such as a transmitter, a receiver, a transceiver, a modem and/or network interface card to facilitate exchange of data with external machines (e.g., computing devices of any kind) via a network 926 (e.g., an Ethernet connection, a digital subscriber line (DSL), a telephone line, coaxial cable, a cellular telephone system, etc.).

The processor platform 3600 of the illustrated example also includes one or more mass storage devices 3628 for storing software and/or data. Examples of such mass storage devices 3628 include floppy disk drives, hard drive disks, compact disk drives, Blu-ray disk drives, RAID systems, and digital versatile disk (DVD) drives.

The coded instructions 3632 of FIG. 34 may be stored in the mass storage device 3628, in the volatile memory 3614, in the non-volatile memory 3616, and/or on a removable tangible computer readable storage medium such as a CD or DVD.

The pop-up displays disclosed herein can be used for point-of-sale advertising, providing information, or for other suitable purposes. The pop-up display may be shipped to a customer in a folded, flat state, and then unfurled to assume the deployed state. In some examples, the display includes first elastic bands that are in a state of tension when the display is in the folded, flat state because forces imparted by the folded material of the display are greater than a force exerted by the first elastic bands. However, when the display is unfolded, the force imparted on the first elastic bands is less than the force exerted by the first elastic bands, thereby enabling the first elastic bands to urge the display from the folded position to the deployed position.

In some examples, the display is formed using a first elongate substrate and a second elongate substrate. In such examples, the first elongate substrate includes a first inward facing flap along a first side edge, a first panel, a first sub-panel, and a second inward facing flap including a first stop along a second side edge. In some examples, the first panel is disposed between the first flap and the first sub-panel, and the first sub-panel is disposed between the first panel and the second flap. Likewise, in such examples, the second elongate substrate includes a third inward facing flap along a third side edge, a third panel, a second sub-panel, and a fourth inward facing flap including an example second stop along a fourth side edge. The third panel is disposed between the third flap and the second sub-panel, and the second sub-panel is disposed between the third panel and the fourth flap.

To form the display, the first flap and the third flap are coupled, and the second flap and the fourth flap are coupled. Specifically, the first and third flaps are coupled using second elastic bands that longitudinally extend along the first and third flaps between eyelets. Also, the second and fourth flaps are coupled using third elastic bands that longitudinally extend along the second and fourth flaps between eyelets.

Coupling the second and fourth flaps couples the first and second stops. In addition, coupling the second and fourth flaps places the first sub-panel immediately adjacent to the second sub-panel such that a combined width of the first sub-panel and the second sub-panel is approximately equal to the width of the first panel or the second panel.

To urge the display toward the deployed position, the first elastic bands are coupled between the first and second stops and the first flap and the third flap. Specifically, the first elastic bands are coupled through a first aperture in the first stop and a second aperture of the second stop at one end of the first elastic bands and through eyelets at a second end of the first elastic bands. When the first and second stops are coupled to the first and third flaps, an end of the first stop and an end of the second stop are urged into a vertex formed by the first and second panels. Further, the display also has transverse line of weakness that separate the display into three sections. Also, there is an optional base.

An example apparatus includes a first panel; a second panel; a third panel, when in an erected position, the first panel, the second panel, and the third panel form a triangular cross-section; and a stop extending between a base of one of the first panel, the second panel, or the third panel and a vertex of the others of the first panel and the second panel, the first panel and the third panel, or the second panel and the third panel, the stop to prevent movement of the vertex toward the base.

In some examples, the third panel includes a first sub-panel and a second sub-panel. In some examples, the apparatus includes a first substrate and a second substrate, the first substrate including the first panel and the first sub-panel and the second substrate including the second panel and the second sub-panel. In some examples, the first substrate defines a first line of weakness to separate the first panel and the first sub-panel and the second substrate defines a second line of weakness to separate the second panel and the second sub-panel. In some examples, the vertex is a first vertex, the first line weakness defines a second vertex and the second line of weakness defines a third vertex. In some examples, urging the second vertex toward the third vertex against the biasing force is to increase the distance between the first vertex and the base moves the apparatus from a deployed state to a collapsed state.

In some examples, the first substrate includes a first side edge and the second substrate includes a second side edge, the first side edge coupled to the second side edge at the vertex. In some examples, the substrate includes a first transverse line of weakness and the second substrate includes a second transverse line of weakness, the first and second transverse lines of weakness to be immediately adjacent one another when the apparatus is collapsed. In some examples, the apparatus is foldable about the first and second transverse lines of weakness. In some examples, the apparatus includes a flap and a biasing element, the biasing element coupled to the flap to urge the stop to extend between the base of one of the first panel, the second panel, or the third panel and the vertex of the others of the first panel and the second panel, the first panel and the third panel, or the second panel and the third panel.

In some examples, the flap is integral to one of the first panel, the second panel, or the third panel. In some examples, the stop is integral to one of the first panel, the second panel, or the third panel. In some examples, the biasing element is to deter the stop from engaging an end of the flap. In some examples, the biasing element is coupled to the stop to urge the stop to extend between the base of one of the first panel, the second panel, or the third panel and the vertex of the others of the first panel and the second panel, the first panel and the third panel, or the second panel and the third panel. In some examples, the apparatus is a self-erecting display.

An example apparatus includes a shroud including a first panel, a second panel, and a third panel, an interior formed between the first panel, the second panel, and the third panel; and a stop extending between one of the first panel, the second panel, or the third panel and a vertex of the others of the first panel and the second panel, the first panel and the third panel, or the second panel and the third panel. In some examples, the interior has a triangular cross-section. In some examples, the apparatus includes a substrate including the first panel, the second panel, and the third panel. In some examples, the stop is integral to one of the first panel, the second panel, or the third panel. In some examples, the apparatus includes to urge the stop to extend between the one of the first panel, the second panel, or the third panel and the vertex of the others of the first panel and the second panel, the first panel and the third panel, or the second panel and the third panel.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a first panel;

a second panel;

a third panel, when in an erected position, the first panel, the second panel, and the third panel form a triangular cross-section;

a stop extending between a base of one of the first panel, the second panel, or the third panel and a vertex of the others of the first panel and the second panel, the first panel and the third panel, or the second panel and the third panel, the stop to prevent movement of the vertex toward the base; and a guide that prevents the stop from passing across an axis of the apparatus, the axis extends through the vertex and is substantially perpendicular to the base.

2. The apparatus of claim 1, wherein the third panel includes a first sub-panel and a second sub-panel.

3. The apparatus of claim 2, further including a first substrate and a second substrate, the first substrate including the first panel and the first sub-panel and the second substrate including the second panel and the second sub-panel.

4. The apparatus of claim 3, wherein the first substrate includes a first line of weakness to separate the first panel and the first sub-panel and the second substrate includes a second line of weakness to separate the second panel and the second sub-panel.

5. The apparatus of claim 4, wherein the vertex is a first vertex, the first line weakness defines a second vertex and the second line of weakness defines a third vertex.

6. An apparatus, comprising:

a first substrate including a first panel and a first sub-panel, the first substrate includes a first line of weakness to separate the first panel and the first sub-panel, the first line of weakness defining a first vertex when the apparatus is in an erected position;

a second substrate including a second panel and a second sub-panel, the second substrate includes a second line of weakness to separate the second panel and the second sub-panel, the second line of weakness defining a second vertex when the apparatus is in the erected position, the first sub-panel and the second sub-panel form a base, and the first panel, the second panel, and the base form a triangular cross-section when the apparatus is in the erected position;

a stop extending between the base and a third vertex between the first panel and the second panel, the stop to prevent movement of the third vertex toward the base, wherein urging the first vertex toward the second vertex against a biasing force is to increase a distance between the third vertex and the base and moves the apparatus from a deployed state to a collapsed state.

7. The apparatus of claim 3, wherein the first substrate includes a first side edge and the second substrate includes a second side edge, the first side edge coupled to the second side edge at the vertex.

8. The apparatus of claim 3, wherein the substrate includes a first transverse line of weakness and the second substrate includes a second transverse line of weakness, the first and second transverse lines of weakness to be immediately adjacent one another when the apparatus is collapsed.

9. The apparatus of claim 8, wherein the apparatus is foldable about the first and second transverse lines of weakness.

10. The apparatus of claim 1, further including a flap and a biasing element, the biasing element coupled to the flap to urge the stop to extend between the base of the one of the first panel, the second panel, or the third panel and the vertex of the others of the first panel and the second panel, the first panel and the third panel, or the second panel and the third panel.

11. The apparatus of claim 10, wherein the flap is integral to one of the first panel, the second panel, or the third panel.

12. An apparatus, comprising:

a first panel;

a second panel;

a third panel, when in an erected position, the first panel, the second panel, and the third panel form a triangular cross-section;

a stop extending between a base of one of the first panel, the second panel, or the third panel and a vertex of the others of the first panel and the second panel, the first panel and the third panel, or the second panel and the third panel, the stop to prevent movement of the vertex toward the base; and a flap and a biasing element, the biasing element coupled to the flap to urge the stop to extend between the base of one of the first panel, the second panel, or the third panel and the vertex of the others of the first panel and the second panel, the first panel and the third panel, or the second panel and the third panel, wherein the stop is integral to one of the first panel, the second panel, or the third panel.

13. The apparatus of claim 10, wherein the biasing element is to deter the stop from engaging an end of the flap.

14. The apparatus of claim 10, wherein the biasing element is coupled to the stop to urge the stop to extend between the base of the one of the first panel, the second panel, or the third panel and the vertex of the others of the first panel and the second panel, the first panel and the third panel, or the second panel and the third panel.

15. The apparatus of claim 1, wherein the apparatus is a self-erecting display.

16. An apparatus, comprising:

a shroud including a first panel, a second panel, and a third panel, an interior formed between the first panel, the second panel, and the third panel;

a stop extending between one of the first panel, the second panel, or the third panel and a vertex of the others of the first panel and the second panel, the first panel and the third panel, or the second panel and the third panel; and a biasing element coupled to the stop and a flap of one or more of the first panel, the second panel, or the third panel, the biasing element to guide movement of the stop and to prevent the stop from engaging an end of the flap.

17. The apparatus of claim 16, wherein the interior has a triangular cross-section.

18. The apparatus of claim 16, furthering including a substrate including the first panel, the second panel, and the third panel.

19. An apparatus, comprising:

a shroud including a first panel, a second panel, and a third panel, an interior formed between the first panel, the second panel, and the third panel; and a stop extending between the first panel and a vertex formed between the second panel and the third panel, wherein the stop is integral to one of the first panel, the second panel, or the third panel.

20. The apparatus of claim 19, further including a biasing element to urge the stop to extend between the first panel and the vertex.

21. The apparatus of claim 1, wherein the guide is coupled between the stop and the vertex or the base to deter the stop from engaging a coupling between two or more of the first panel, the second panel, or the third panel.

22. The apparatus of claim 1, wherein the guide is a biasing element.

23. The apparatus of claim 19, further including a guide to deter the stop from engaging a coupling between two or more of the first panel, the second panel, or the third panel or a flap of one or more of the first panel, the second panel, or the third panel.

* * * * *